US012734414B1

(12) United States Patent
LeBlanc et al.

(10) Patent No.: US 12,734,414 B1
(45) Date of Patent: Sep. 15, 2026

(54) GOLF CLUB HEADS WITH VARIABLE THICKNESS COMPOSITE COMPONENTS AND METHOD OF MANUFACTURING

(71) Applicant: Topgolf Callaway Brands Corp., Carlsbad, CA (US)

(72) Inventors: Dominic LeBlanc, Carlsbad, CA (US); Brandon DeMille, Carlsbad, CA (US)

(73) Assignee: Callaway Gold Company, Carlsbad, CA (US)

( * ) Notice: Subject to any disclaimer, the term of this patent is extended or adjusted under 35 U.S.C. 154(b) by 463 days.

(21) Appl. No.: 17/931,892

(22) Filed: Sep. 13, 2022

Related U.S. Application Data

(60) Provisional application No. 63/244,640, filed on Sep. 15, 2021.

(51) Int. Cl.
*A63B 53/04* (2015.01)

(52) U.S. Cl.
CPC ..... *A63B 53/0458* (2020.08); *A63B 53/0425* (2020.08)

(58) Field of Classification Search
CPC . A63B 53/04; A63B 53/0458; A63B 53/0425; A63B 2209/02; A63B 2209/023; A63B 53/0433; A63B 53/0437; A63B 53/0466; A63B 53/0408
USPC ..... 473/324–350, 287–292
See application file for complete search history.

(56) References Cited

U.S. PATENT DOCUMENTS

| | | | | |
|---|---|---|---|---|
| 4,031,181 | A * | 6/1977 | Schaefer | A63B 60/00 264/258 |
| 4,990,207 | A * | 2/1991 | Sakai | B29C 70/345 156/263 |
| 5,425,538 | A * | 6/1995 | Vincent | A63B 53/0466 473/347 |
| 6,059,669 | A * | 5/2000 | Pearce | A63B 53/04 473/339 |
| 6,399,199 | B1 * | 6/2002 | Fujino | C08L 63/00 428/375 |
| 6,435,980 | B1 * | 8/2002 | Reyes | B29C 70/342 428/323 |
| 6,992,029 | B1 * | 1/2006 | Chou | D03D 15/267 139/420 C |
| 9,033,822 | B1 * | 5/2015 | DeMille | A63B 60/00 473/347 |
| 9,056,230 | B2 * | 6/2015 | Golden | A63B 60/02 |
| 9,511,571 | B2 * | 12/2016 | Montgomery | B29C 70/08 |
| 10,647,084 | B2 * | 5/2020 | Meure | B32B 27/288 |
| 11,850,478 | B1 * | 12/2023 | Roach | B29C 70/34 |

(Continued)

FOREIGN PATENT DOCUMENTS

| | | | |
|---|---|---|---|
| CA | 2957247 | A1 * | 2/2016 |
| EP | 3064536 | A1 * | 9/2016 |

(Continued)

*Primary Examiner* — Sebastiano Passaniti
(74) *Attorney, Agent, or Firm* — Michael A. Catania; Daniel Moderick

(57) ABSTRACT

A golf club head with a composite component, such as a crown or a sole, where the composite component has a variable cross-sectional thickness, resulting from imposition of non-uniform pattern of slits cut into one or more charges prior to layup, introduction of resin, and curing is disclosed herein. Methods of making such composite components are also disclosed.

20 Claims, 42 Drawing Sheets

(56) References Cited

U.S. PATENT DOCUMENTS

| | | | | |
|---|---|---|---|---|
| 2005/0090330 | A1* | 4/2005 | Kumamoto | A63B 60/52 473/345 |
| 2005/0215352 | A1* | 9/2005 | Oyama | A63B 60/00 473/345 |
| 2008/0146374 | A1* | 6/2008 | Beach | A63B 60/00 473/350 |
| 2012/0190473 | A1* | 7/2012 | Swist | A63C 5/07 473/282 |
| 2013/0095282 | A1* | 4/2013 | Taketa | B32B 3/266 428/113 |
| 2014/0004296 | A1* | 1/2014 | Khokar | D04C 1/02 428/196 |
| 2015/0174872 | A1* | 6/2015 | Bonneau | B32B 27/12 156/307.1 |
| 2016/0194468 | A1* | 7/2016 | Ogasawara | B29B 15/08 524/495 |
| 2019/0022478 | A1* | 1/2019 | Greaney | B32B 5/26 |
| 2021/0339499 | A1* | 11/2021 | Mencattelli | B32B 5/024 |

FOREIGN PATENT DOCUMENTS

| | | | | |
|---|---|---|---|---|
| ES | 2808202 | T3 | * | 2/2021 |
| JP | H09512504 | A | * | 12/1997 |
| WO | WO-9229521 | A1 | * | 11/1992 |

* cited by examiner

Variable Thickness Sole Standard Composite Layup

Flow Behavior Within Charge With a Uniform Slit Pattern

Variable Thickness Sole
Simple Uniform Slit Composite Layup

Non-Uniform Slit Crown Layup Example 1

Cross Section of Unidirectional and Multiaxial Composite Layer Laminate

GOLF CLUB HEADS WITH VARIABLE THICKNESS COMPOSITE COMPONENTS AND METHOD OF MANUFACTURING

CROSS REFERENCES TO RELATED APPLICATIONS

The present application claims priority to U.S. Provisional Application No. 63/244,640, filed on Sep. 15, 2021, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with one or more components having varying thickness made of low density, high durability composites comprising non-uniform patterned slits at the ply level.

Description of the Related Art

The center of gravity (CG) of a golf head is crucial to its performance because it affects the spin and launch profile of a golf ball as it leaves the golf head. Manufacturers often combine metallic golf club head bodies with composite crowns in an attempt to lower the center of gravity and thereby improve the overall mass properties of the head. Composite soles can also be used to increase the overall golf club head moment of inertia and dial in a specific CG depth or bias. For example, composite patches located in the toe area of a sole driver design, such as those used in Callaway's Epic Max drivers, illustrated in prior art FIGS. 1*a-d*, move the CG heel-ward, and promote draw bias.

Low-density composite golf club components such as crowns, soles, and patches are designed to be as light as possible while at the same time satisfying various design requirements, including: (1) overall durability of the composite components when subjected to the golf head repeatedly and regularly impacting a golf ball; (2) overall durability of the composite components subjected to golfer abuse (e.g., impact on a sole of a golf club head when it makes contact with the ground); (3) minimum stiffness requirements for thin components; and (4) association with a natural auditory frequency above a certain threshold, as a frequency that is too low can be unappealing to the golfer.

Golf club manufacturers can use constant thickness composite crowns or soles such as those prior art components shown in FIGS. 2*a-b*, and 3*a-b*. Such constant thickness composite components can be manufactured with conventional techniques, by stacking or "laying up" a number of plies (also referred to as "charges") of reinforcing fiber and then introducing a matrix resin that is cured to form a finished composite part. The reinforcing fiber can be any number of different types of fiber, with various matrix resin flow directionality properties and resultant mechanical strength properties. For example, such reinforcing fiber may be unidirectional, or multi-axial, as explained in greater detail below. One such prior art layup is illustrated in FIG. 6.

However, evolving demands for high performance composite components and the requirements imposed on golf club head composite components often lead to the use of variable thickness composite components, examples of which are illustrated in FIGS. 4*a-b* and 5*a-b*. This is because changing the cross-sectional thickness throughout the composite component allows for the creation of a more optimized and lightweight solution.

The creation of complex composite components of variable thickness poses manufacturing challenges, however. With reference to FIG. 7, when using conventional techniques with continuous fiber composites for compression molding, plies of unidirectional or multi-axial composites are stacked or "laid up" and processed in a mold to obtain a desired part. As illustrated by FIG. 7, although a composite sole of variable thickness is possible, its manufacture requires a significantly more complex layup than that required for a constant thickness composite component. Specifically, the conventional technique for a variable thickness composite component requires the use of a greater number of charges/plies, and requires that some of those plies have unique and oddly shaped profiles. Moreover, such unique and oddly shaped charges must be precisely placed in the layup, with respect to the other plies. Each of these complexities increases manufacturing costs, through increased materials costs, increased labor costs, increased time to manufacture, and increased wastage due to errors in layup.

Prior art sheet molding compounds (SMC) and prior art bulk molding compounds (BMC) can also be useful for creating variable thickness components because SMCs and BMCs include chopped fibers or discontinuous fiber tows (yarns) distributed throughout an uncured matrix resin. The fiber and resin of these materials, when molded, flow into complex features in the mold cavity, such as ribs and variable thickness walls. However, cured SMCs and BMCs can have inconsistent mechanical properties which are suboptimal for precise applications such as golf club heads. These inconsistent mechanical properties are illustrated experimentally in FIGS. 8 and 9, as well as and Table I below:

TABLE I

| | Normalized Strength Allowable | Normalized Strength | Normalized Strength stdev | Normalized Strength | Normalized Modulus stdev |
|---|---|---|---|---|---|
| UD Carbon Quasi Iso Layup | 0.913 | 1.000 | 0.029 | 0.988 | 0.025 |
| Carbon Slit UD (1" Fiber Length) | 0.789 | 0.928 | 0.046 | 0.925 | 0.051 |

TABLE I-continued

| | Normalized Strength Allowable | Normalized Strength | Normalized Strength stdev | Normalized Strength | Normalized Modulus stdev |
|---|---|---|---|---|---|
| Carbon Slit UD (0.5" Fiber Length) | 0.675 | 0.888 | 0.071 | 0.950 | 0.101 |
| Carbon SMC (1" Fiber Length) | 0.311 | 0.808 | 0.166 | 0.913 | 0.038 |

For example, a prior art carbon SMC has a bending strength allowable 55% lower than that of a continuous fiber material counterpart.

With reference to FIGS. 10-16, another prior art approach uses reinforcing fiber charges that have uniform, mechanically made slits. These uniform, mechanically made slits, in either unidirectional or multi-axial fiber reinforcement fabrics, can increase the flowability of the resin matrix in such uniformly slitted fabric charges. These slits increase the flow of the material in the fiber direction during a standard compression molding process when compared with the original un-slitted, continuous fiber fabric, as shown in FIGS. 12-16. The flow behavior of unidirectional continuous composite materials is directly linked to properties of the fiber reinforcement. A composite material with improved flow characteristics allows a limited number of uniformly slit composite plies to replace numerous layers or plies of composite material, as shown in FIG. 17.

The stiffness and strength of the continuous fiber is substantial, namely orders of magnitude higher than the matrix or resin system of a composite system. When normal pressure is applied to a unidirectional composite material, matrix resin is free to flow in a direction transverse to the length of the fiber, as illustrated in FIGS. 12-13. In contrast, in unidirectional composite fiber reinforcement fabric, there is—by design—very limited flow in the fiber direction.

However, with reference to FIGS. 15-16, if slits are introduced in an organized fashion with a repeatable pattern to the unidirectional fabric, the coefficient of variation is greatly reduced compared to standard sheet molding compounds, as shown graphically in FIGS. 8-9. The uniform, mechanically made slits of the prior art, as illustrated in FIGS. 11, and 15-16, cover the entire material surface to ensure that the slit pattern is applied to any part or ply cut from that specific roll.

Unfortunately, when fiber length is reduced in composite materials, such as in the charges illustrated in prior art FIGS. 17 and 19-20, the mechanical properties of the composite are negatively affected. This property is noticeable when comparing continuous fiber composites to sheet molding or bulk molding compounds in FIGS. 8 and 9. Similarly, introducing slits or cuts in continuous fiber reinforcement reduces the average fiber length throughout a finished composite component, thus reducing the overall mechanical strength or performance of that finished composite component, as illustrated graphically in FIG. 18.

In view of the above, there is a need for improved composite materials and processes for manufacturing resilient golf club components and, particularly, materials that: (1) can be molded into variable thickness pieces through compression moldings; (2) maintain as much of their material performance and strength as possible when compared to continuous fiber (unidirectional and multiaxial) fabrics; (3) have a simplified layup for variable thickness components where size and placement of a charge is not directly linked to the final part performance; and (4) allow for the control and modification of material flow within the same charge, e.g., within the different zones of the same ply.

BRIEF SUMMARY OF THE INVENTION

The embodiments disclosed herein are directed to a golf club head with one or more composite components of variable thickness, methods of manufacture, and apparatus for certain steps in the manufacture. The various embodiments disclosed herein have several features, no single one of which is solely responsible for its desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments solve the problems discussed in the Background and provide the advantages described herein.

In general, the embodiments focus on targeted manipulation and modification of the matrix resin distribution properties of various fiber reinforcement, including unidirectional pre-impregnated ("pre-preg") fabrics. Specifically, the embodiments disclose various methods and specific implementations thereof for making non-uniform and patterned slits or cuts in a ply of fiber reinforcement, to convert certain zones in a ply from a continuous fiber matrix with unidirectional resin flow, into a discontinuous matrix with multi-directional resin flow. As a result, zones of discontinuous fiber can have a greater multi-directional resin flow and accumulation of matrix resin, and after curing, can have a thicker cross-section than zones in the ply that remain intact and continuous. Such methods and embodiments can enable a manufacturer to design for specific thicknesses, strengths, and weights in a composite component, while achieving these advantages using fewer plies of conventional reinforcing fabric.

In a first aspect, a golf club head with a component formed from composite materials is provided, the component including a plurality of plies of reinforcement fabric, a quantity of cured matrix, where the matrix is bonded to the plurality of plies of reinforcement fabric to form a unitary composite component, where at least a first ply of reinforcement fabric of the plurality of plies of reinforcement fabric comprises a first plurality of tows, where the first ply has a first zone in which the first ply has been cut with a plurality of slits such that the first plurality of tows in the first zone are discontinuous, where the first ply has a second zone in which the first plurality of tows in the second zone are intact and continuous, where the first zone has a first cross-sectional thickness comprising the thickness of the first ply and the thickness of the cured matrix at the first zone, where the second zone has a second cross-sectional thickness comprising the thickness of the first ply and the thickness of the cured matrix at the second zone, where the first cross-sectional thickness is greater than the second cross-sectional thickness, and whereby the component has a component cross-sectional thickness that varies across the cross-section of the component.

In an embodiment of the first aspect, the component is a golf club head crown.

In a further embodiment of the first aspect, the component is a golf club head sole.

In a further embodiment of the first aspect, the first ply has a third transitional zone positioned between the first zone and the second zone, and the third transitional zone has a third cross-sectional thickness comprising the thickness of the first ply and the thickness of the cured matrix at the third zone, and where the third-cross-sectional thickness is less than the first cross-sectional thickness but greater than the second cross-sectional thickness.

In a further embodiment of the first aspect, the golf club head also has a first thickness defined at a first point of the component in the second zone, a second thickness defined at a second point of the component in the first zone, where a component thickness variation is defined as the difference between the second thickness and the first thickness, and where the component thickness variation ranges between 0.010 inch and 0.50 inch.

In a further embodiment of the first aspect, the golf club head also includes a dimension L defined as the length between the first point and the second point, a thickness rate of change defined as the rate of change along the cross-section of the component and which is defined by the formula $$\text{Thickness rate of change} = \frac{\text{Second Thickness} - \text{First Thickness}}{L}$$

and, where the thickness rate of change is in a range between 0 in/in and 5 in/in.

In a further embodiment of the first aspect, the golf club head has a dimension L between 0.010 inch and 0.50 inch.

In a further embodiment of the first aspect, the golf club head also has a first thickness defined at a first point of the component in the second zone, a second thickness defined at a second point of the component in the first zone, where a component thickness variation is defined as the difference between the second thickness and the first thickness, where the component thickness variation ranges between 0.010 inch and 0.50 inch, a dimension L defined as the length between the first point and the second point, where dimension L ranges between 0.010 inch and 0.5 inch, a component thickness rate of change defined as the rate of change along the cross-section of the component and which is defined by the formula $$\text{Thickness}_{Change} = \lim_{h \to 0} \frac{\text{Thickness}(x+h) - \text{Thickness}(x)}{h}$$

where the component thickness rate of change is in a range between 0 in/in and 5 in/in.

In a further embodiment of the first aspect, the golf club head where the first ply also includes an area charge defined as the surface area of the first ply, a cut length defined as the length of each of the plurality of slits, where n is defined as the exact number of slits of the plurality of slits in the first ply, a cut ply ratio defined by the formula $$\text{Cut_Ply_Ratio} = \frac{\left(\sum_{k=1}^{n} \text{Cut_Length}_k\right)}{\text{Area}_{Charge}}$$

and;

where the cut ply ratio is between 0.1 in/in$^2$ and 100 in/in$^2$.

In a further embodiment of the first aspect, the golf club head where the cut length varies between 0.020 inch and 2.00 inches.

In a further embodiment of the first aspect, the golf club head also includes a number m defined as the total number of plies in the plurality of plies, a number n defined as the total number of slits per ply m; where a cut layup ratio is defined by the formula $$\text{Cut}_{Layup_{Ratio}} = \frac{\left(\sum_{k=1}^{m} \sum_{k=1}^{n} (\text{Cut_Length}_k)\right)}{\sum_{k=1}^{m} \text{Area}_{charge_k}}$$

and;

where the cut layup ratio varies in a range between 0.05 in/in$^2$ and 200 in/in$^2$.

In a further embodiment of the first aspect, the plurality of slits are configured in a pattern.

In a further embodiment of the first aspect, the pattern is oval-shaped, circular-shaped, kidney-shaped, ring-shaped, or concentrated around the perimeter of the first ply.

In a further embodiment of the first aspect, at least some of the plurality of slits are straight line segments.

In a further embodiment of the first aspect, at least some of the plurality of slits are curves.

In a further embodiment of the first aspect, the curves have a minimum radius of curvature of 0.10 inch.

In a further embodiment of the first aspect, the matrix is a thermosetting resin.

In a further embodiment of the first aspect, the matrix is a thermosetting resin material selected from the group consisting of epoxy, polyester, or vinyl ester.

In a further embodiment of the first aspect, the matrix is a thermoplastic resin.

In a further embodiment of the first aspect, the matrix is a thermoplastic resin material selected from the group consisting of nylon, polycarbonate, PPS, PEKK, or PEEK.

In a further embodiment of the first aspect, the first ply of reinforcement fabric is a reinforcement fabric selected from the group consisting of carbon, fiberglass, and aramid.

In a further embodiment of the first aspect, the first ply of reinforcement fabric has a fabric area weight between 20 grams per square meter (gsm) and 500 gsm.

In a further embodiment of the first aspect, the first ply of reinforcement fabric is comprised of unidirectional fabric where the first plurality of tows are nonwoven and all oriented in the same direction.

In a further embodiment of the first aspect, the first ply of reinforcement fabric is comprised of woven multi-axial fabric.

In a further embodiment of the first aspect, the first ply of reinforcement fabric is comprised of pre-preg.

In a further embodiment of the first aspect, a second ply of reinforcement fabric of the plurality of plies of reinforcement fabric comprises a second plurality of tows, where the second ply is oriented with respect to the first ply such that the second plurality of tows is not parallel to the first plurality of tows.

In a further embodiment of the first aspect, the second ply has a fourth zone in which the second ply has been cut with a plurality of slits such that the second plurality of tows in the fourth zone are discontinuous, where the second ply has a fifth zone in which the second plurality of tows in the fifth zone are intact and continuous and where the positioning of the plurality of slits in the fourth zone are different from the positioning of the plurality of slits in the first zone.

In a further embodiment of the first aspect, the number of plies of the plurality of plies vary between 2 and 50.

In a second aspect, a composite layup that is compressed and ready for curing is provided, including a plurality of plies of reinforcement fabric, a quantity of uncured matrix, where the matrix is in contact with the reinforcement fabric, where at least a first ply of reinforcement fabric of the plurality of plies of reinforcement fabric includes a plurality of tows, where the first ply has a first zone in which the first ply has been cut with a plurality of slits such that the tows in the first zone are discontinuous, where the first ply has a second zone in which the tows in the second zone are intact and continuous, where the first zone has a first cross-sectional thickness including the thickness of the first ply and the thickness of the uncured matrix at the first zone, wherein the second zone has a second cross-sectional thickness including the thickness of the first ply and the thickness of the uncured matrix at the second zone, where the first cross-sectional thickness is greater than the second cross-sectional thickness, and whereby the component has a component cross-sectional thickness that varies across the cross-section of the component.

In a third aspect, an apparatus for preparing pre-slit reinforcement fiber plies for use in a composite layup is provided, including, a backer board, a plurality of pattern blades affixed to the backer board in a desired pattern, a mechanical press with a field for positioning and securing one or more reinforcement fiber plies, and where the backer board is positioned in the mechanical press, such that upon actuation of the mechanical press, the backer board is brought into proximity of the field, such that the plurality of pattern blades will cut slits into the one or more reinforcement fiber plies.

In an embodiment of the third aspect, the pre-slitting apparatus includes a charge blade configured in the profile of the desired shape of a reinforcement fiber ply charge, where the charge blade is affixed to the backer board such that it generally surrounds the plurality of pattern blades, and whereby upon actuation of the mechanical press, the backer board is brought into proximity of the field, such that the charge blade will cut a desired shape of a reinforcement fiber ply charge from the one or more reinforcement fiber plies.

In a fourth aspect, a method of manufacturing a variable thickness composite part is provided, the steps of the method including selecting a reinforcing fiber fabric, selecting a matrix resin, cutting a plurality of shaped plies from the reinforcing fiber fabric, cutting a pattern of slits in a first ply of the plurality of plies, where the first ply comprises a first plurality of tows, where the first ply has a first zone in which the first ply has been cut with a plurality of slits such that the first plurality of tows in the first zone are discontinuous, where the first ply has a second zone in which the first plurality of tows in the second zone are intact and continuous, preparing a layup by stacking and orienting the plurality of plies in a mold, applying vacuum to the layup, introducing the selected matrix resin to the layup under vacuum, where upon introduction of the selected matrix to the layup under vacuum, the first zone has a first cross-sectional thickness comprising the thickness of the first ply and the thickness of the cured matrix at the first zone, wherein the second zone has a second cross-sectional thickness comprising the thickness of the first ply and the thickness of the cured matrix at the second zone, where the first cross-sectional thickness is greater than the second cross-sectional thickness, and curing the matrix resin to form a hardened variable thickness composite part wherein the composite part has a composite part cross-sectional thickness that varies across the cross-section of the composite part.

In an embodiment of the fourth aspect, the step of cutting the pattern of slits in the first ply includes positioning a pattern cutting board in a mechanical press, where the pattern cutting board includes a backer board, a plurality of pattern blades affixed to the backer board in a desired pattern, where the mechanical press comprises a field for positioning, securing the first ply, and actuating the mechanical press, such that the backer board is brought into proximity of the field, and causes the plurality of pattern blades to cut slits into the first ply.

In another embodiment of the fourth aspect, the step of cutting the pattern of slits in the first ply includes programming an automated cutting table to cut the pattern of slits.

The step of preparing a layup by stacking and orienting the plurality of plies in a mold includes identifying the directionality of the tows of each ply, and stacking the plurality of plies such that the first ply is oriented such that the directionality of the tows of the first ply is not parallel to the directionality of the tows of at least one other ply.

In another embodiment of the fourth aspect, the step of cutting a pattern of slits in a first ply of the plurality of plies includes identifying the directionality of each ply, stacking the plurality of plies in a desired orientation, to form a stack, such that each of the directionality of each ply is selected and maintained with respect to the directionality of each of the other plies in the stack of the plurality of plies, and applying a cutting device to the stack, thereby cutting the same slit pattern in every ply of the stack at the same time.

In another embodiment of the fourth aspect, the step of cutting a pattern of slits in a first ply of the plurality of plies includes identifying the directionality of each ply, stacking the plurality of plies such that the first ply is oriented such that its directionality is not parallel to the directionality of at least one other ply, selecting a pattern of slits comprising a cross-hatch pattern, whereby, when the cross-hatch pattern of slits is applied to the stack, slits will be cut into all plies of the plurality of plies, regardless of the directionality of each particular ply and regardless of the orientation of each particular ply.

Having briefly described the embodiments of the golf club head with variable thickness composite components, the above and further objects, features and advantages thereof will be recognized by those skilled in the pertinent art from the following detailed description when taken in conjunction with the accompanying drawings.

BRIEF DESCRIPTION OF THE SEVERAL VIEWS OF THE DRAWINGS

In the descriptions that follow, like parts or steps are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DETAILED DESCRIPTION OF THE INVENTION

The present embodiments disclose and describe composite materials for golf club heads, and particularly modified, moldable unidirectional and multiaxial composite prepreg comprising non-uniform or custom patterned slits that are introduced at the ply level separate from processing of the composite prepreg. These embodiments are particularly beneficial for manufacturing composite components for the golf club head crown, and golf club head sole. Specifically, the embodiments disclosed herein eases and simplifies the manufacturing of variable thickness crown and sole components for a golf head, such as the one shown in FIGS. 1*a-d*, without compromising the mechanical performance of these components. The embodiments disclosed herein are intended to be instructional and not limiting to the scope of the claims, except where specifically set forth. Moreover, while the description focuses on certain embodiments and uses, it will be understood that this disclosure is non-limiting, and the present embodiments could be applicable to other applications for which variable thickness composite component would be useful.

Figure 1A:
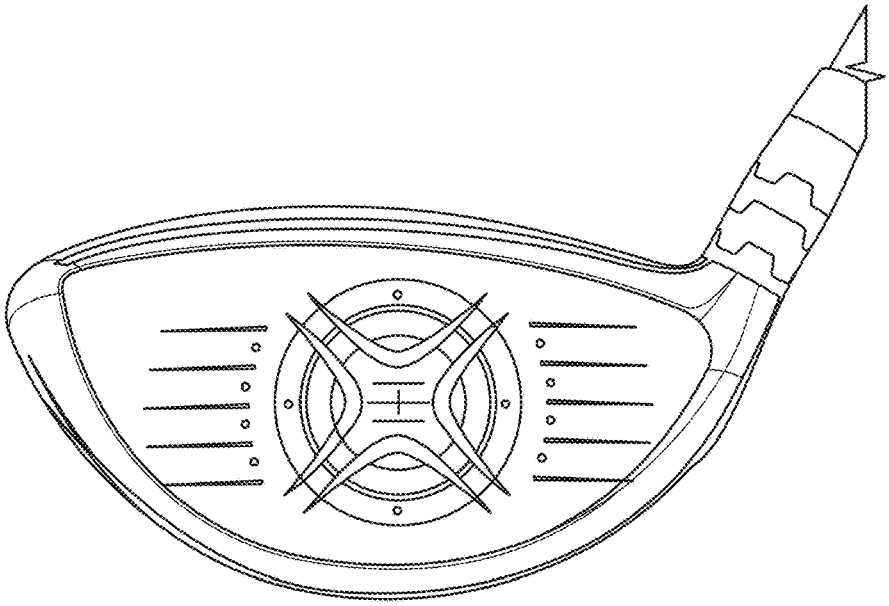
FIG. 1A (PRIOR ART)
FIGS. 1*a*-1*d* are front side, top side, toe side, and bottom side views, respectively, of a prior art golf club head with composite component inserts.
Figure 1B:
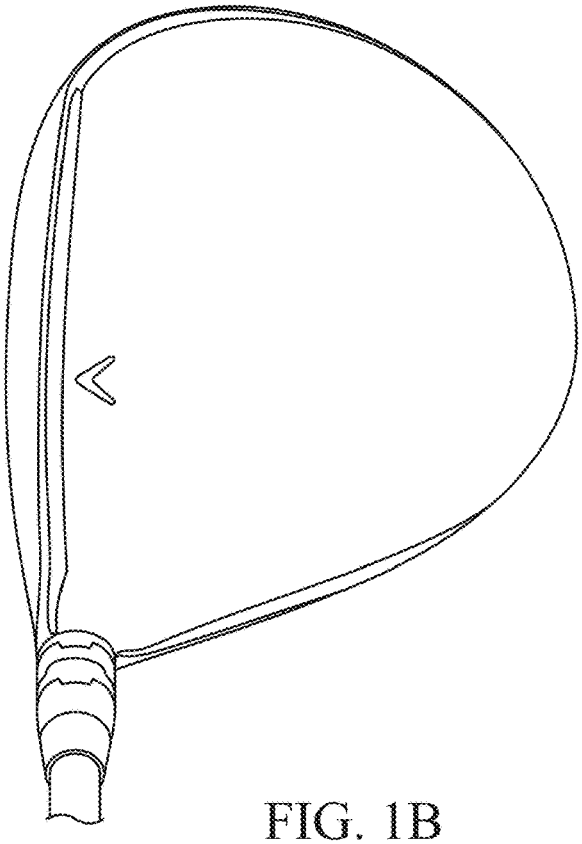
FIG. 1B (PRIOR ART)
Figure 1C:
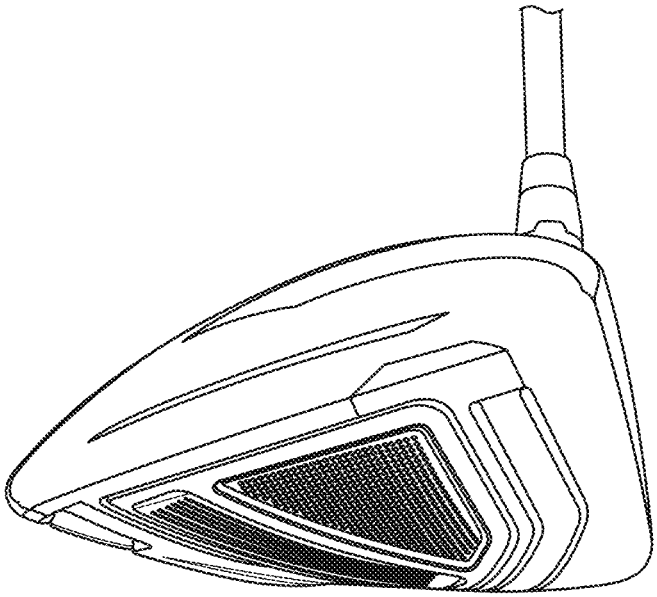
FIG. 1C (PRIOR ART)
Figure 1D:
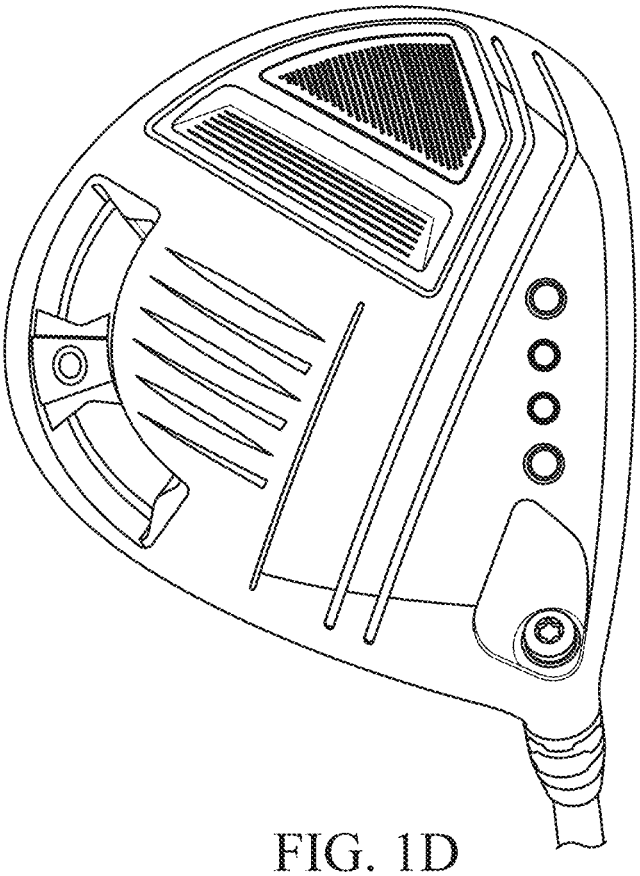
FIG. 1D (PRIOR ART)
Figure 2A:
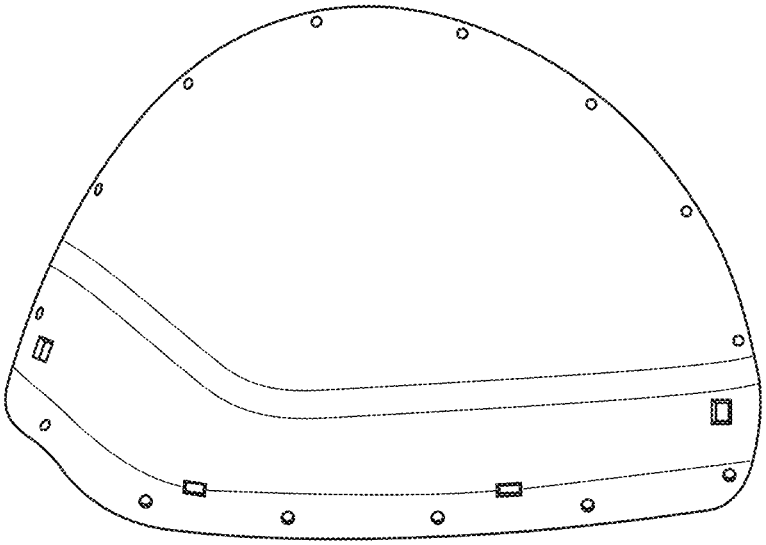
FIG. 2A (PRIOR ART)
FIG. 2*a* is a top view of a prior art constant thickness composite golf club head crown.
Figure 2B:
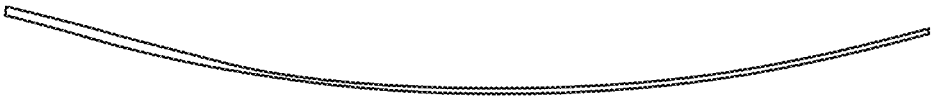
FIG. 2B (PRIOR ART)
FIG. 2*b* is a cross-sectional view of the prior art constant thickness composite golf club head crown of FIG. 2*a;*
Figure 3A:
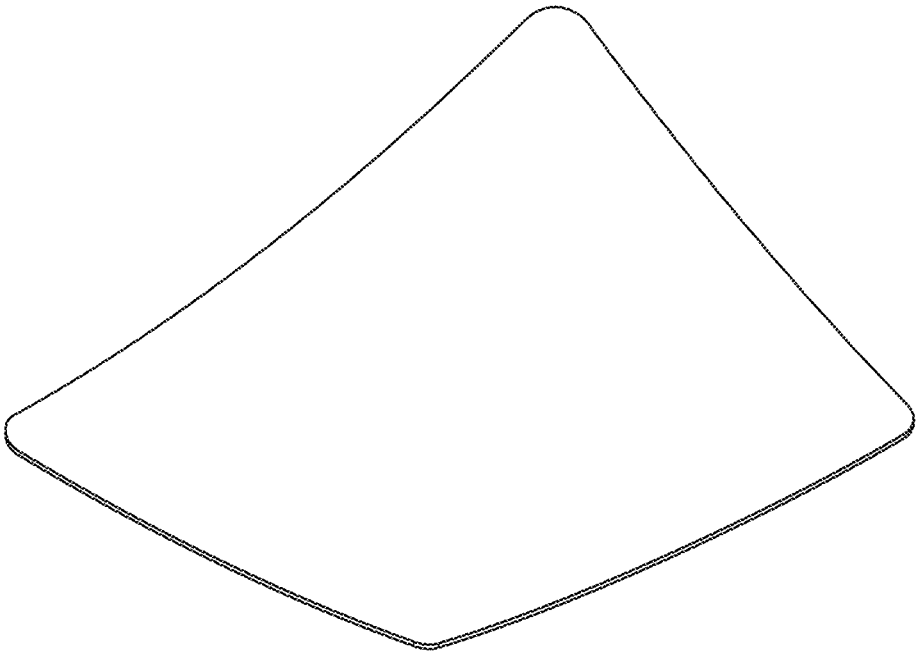
FIG. 3A (PRIOR ART)
FIG. 3*a* is a top view of a prior art constant thickness composite golf club head sole.
Figure 3B:
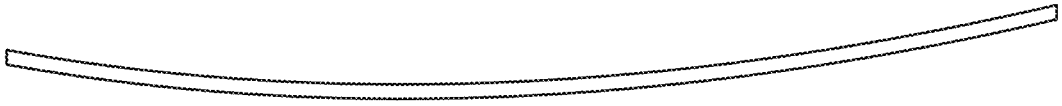
FIG. 3B (PRIOR ART)
FIG. 3*b* is a cross-sectional view of the prior art constant thickness composite golf club head sole of FIG. 3*b;*
Figure 4A:
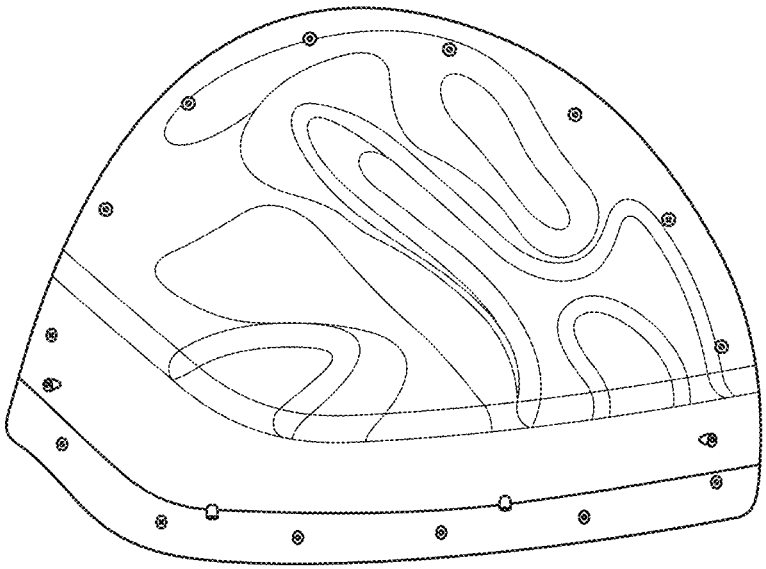
FIG. 4A (PRIOR ART)
FIG. 4*a* is a top view of a prior art variable thickness composite golf club head crown.
Figure 4B:
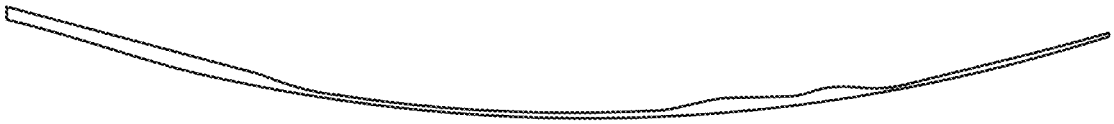
FIG. 4B (PRIOR ART)
FIG. 4*b* is a cross-sectional view of the prior art variable thickness composite golf club head crown of FIG. 4*a;*
Figure 5A:
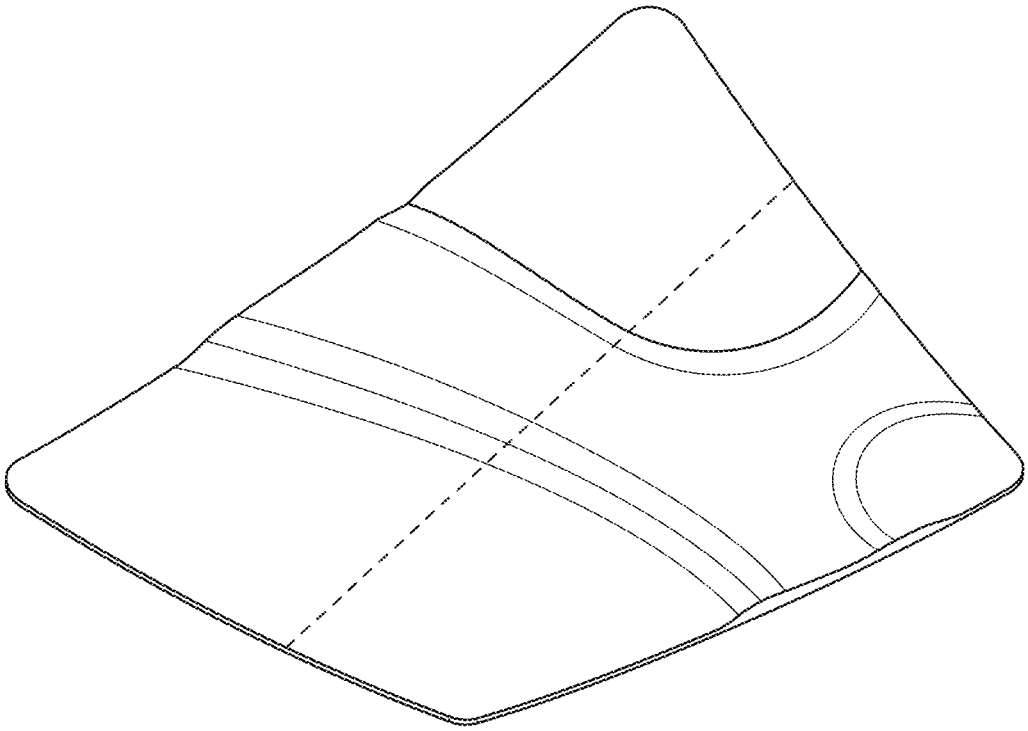
FIG. 5A (PRIOR ART)
FIG. 5*a* is a top view of a prior art variable thickness composite golf club head sole.
Figure 5B:
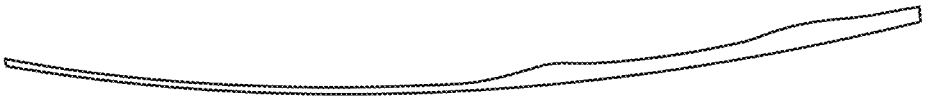
FIG. 5B (PRIOR ART)
FIG. 5*b* is a cross-sectional view of the prior art variable thickness composite golf club head sole of FIG. 5*a;*
Figure 6:
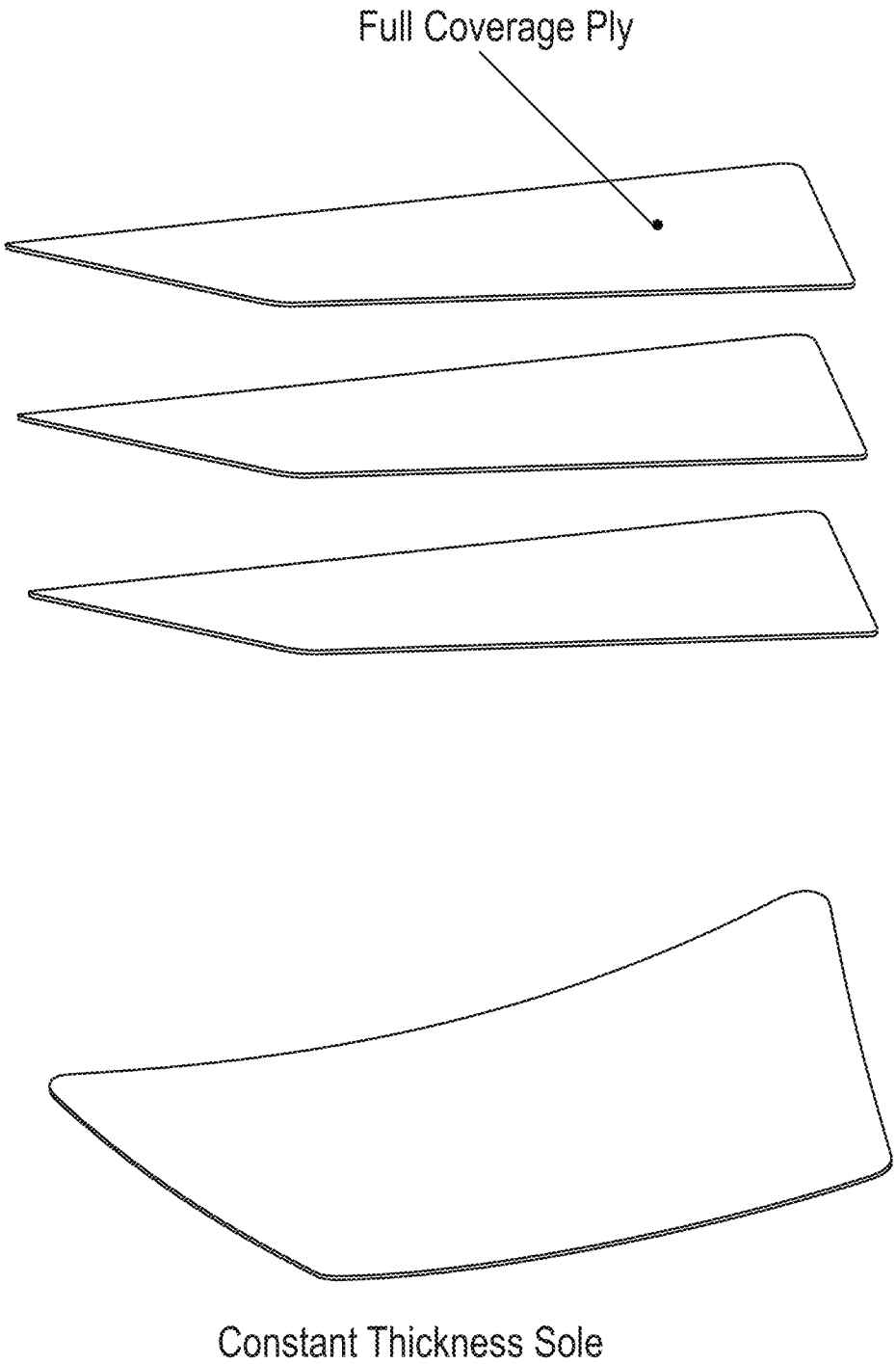
FIG. 6 (PRIOR ART)
FIG. 6 is an exploded view of a layup of plies for manufacture of the prior art constant thickness golf club head sole of FIGS. 3*a-b;*
Figure 7:
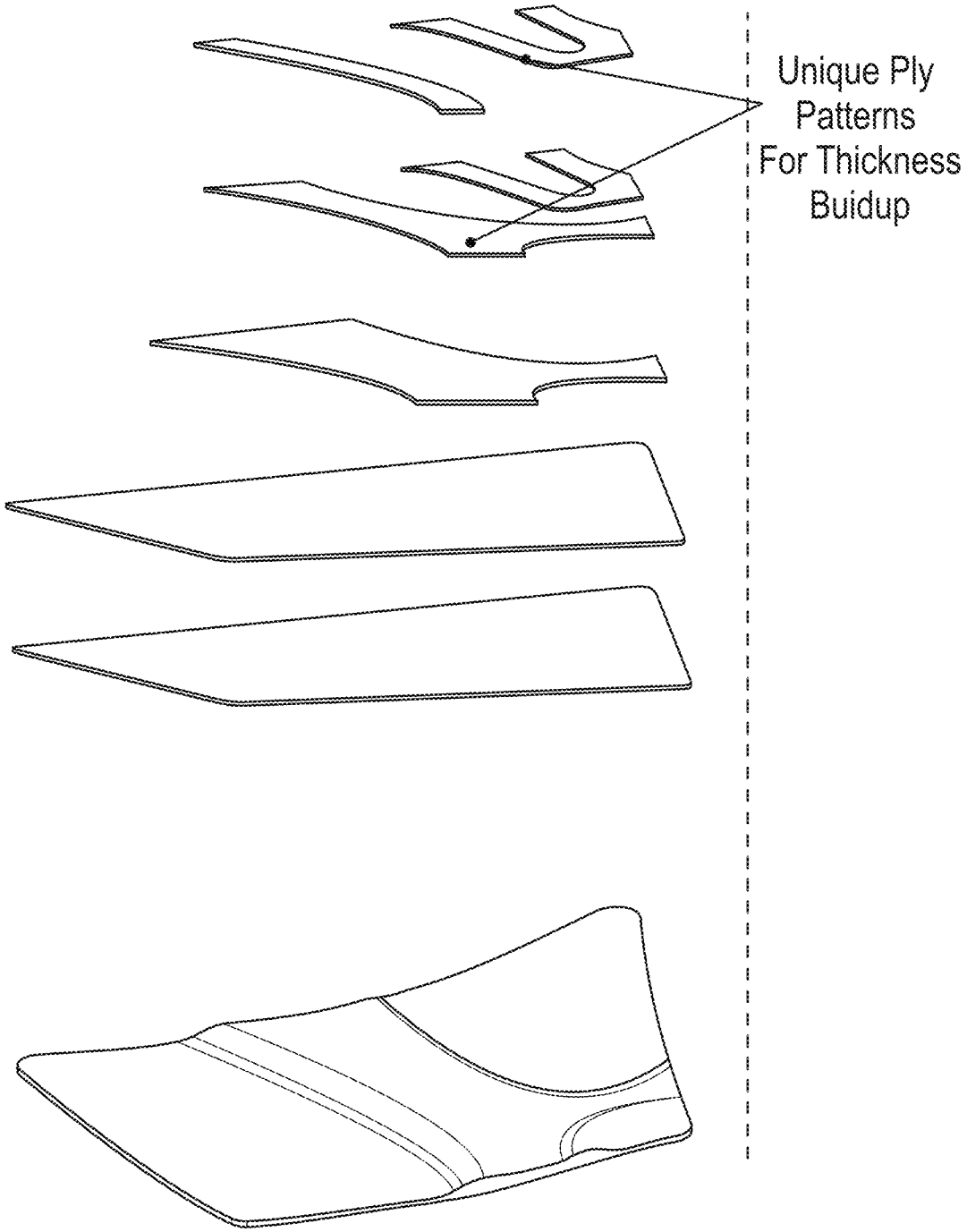
FIG. 7 (PRIOR ART)
FIG. 7 is an exploded view of a layup of plies for manufacture of the prior art variable thickness golf club head sole of FIGS. 5*a-b;*
Figure 8:
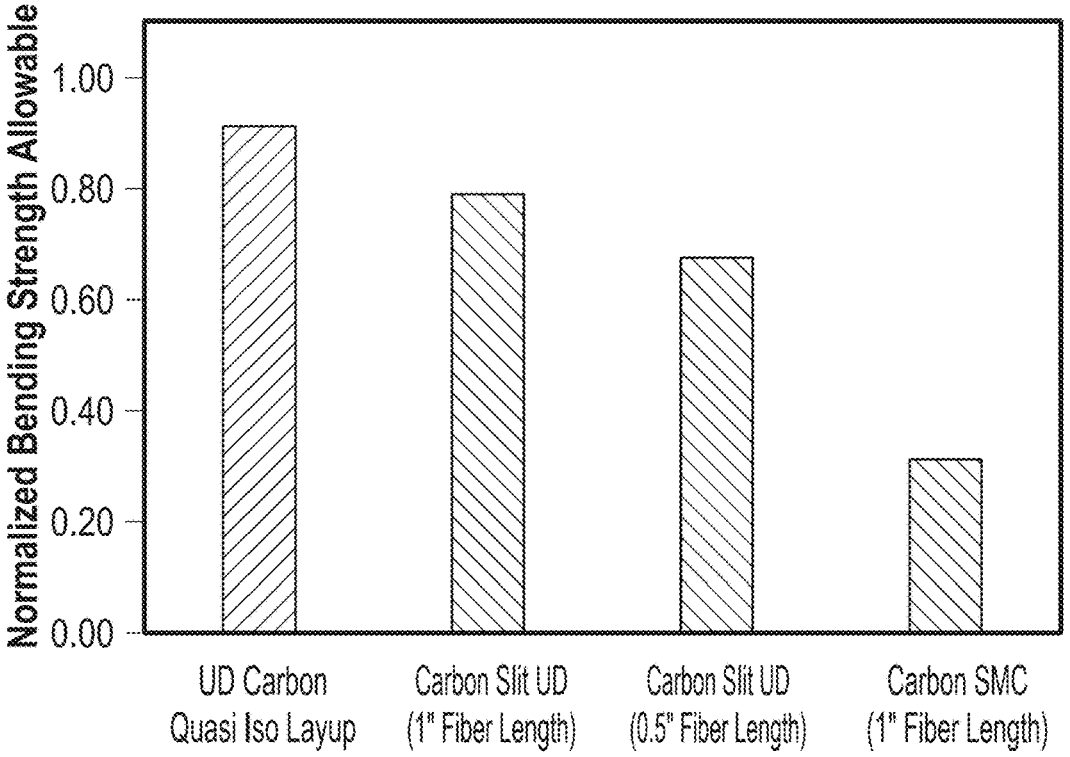
FIG. 8 (PRIOR ART)
FIGS. 8 and 9 are graphs showing the known mechanical properties of different carbon composite materials.
Figure 9:
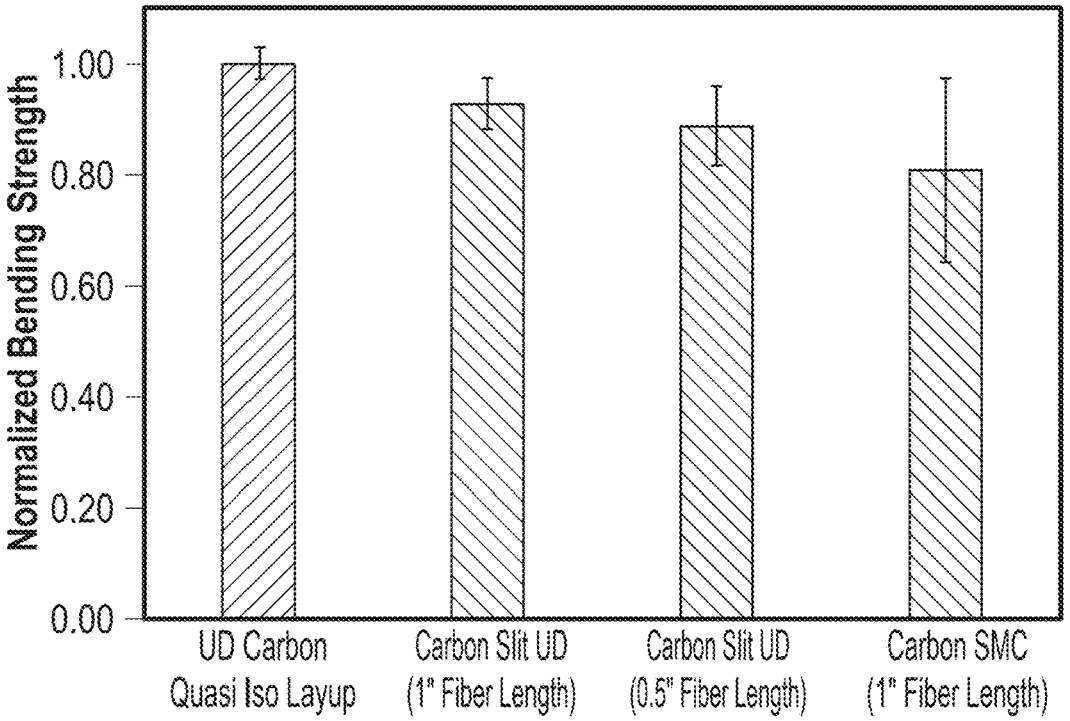
FIG. 9 (PRIOR ART)
Figure 10:
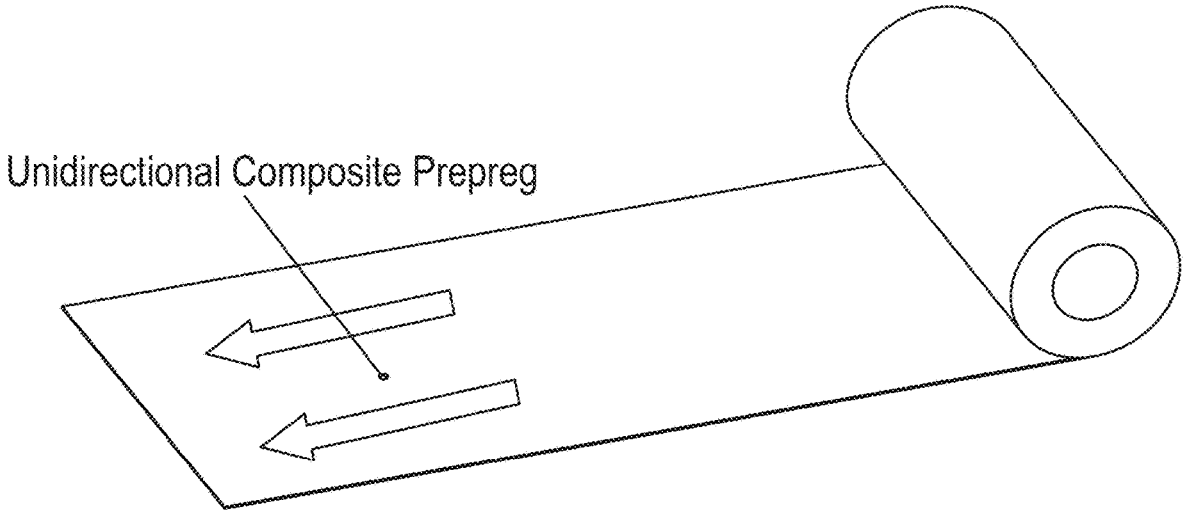
FIG. 10 (PRIOR ART)
FIG. 10 is an illustration of a prior art unidirectional composite prepreg fabric roll.
Figure 11:
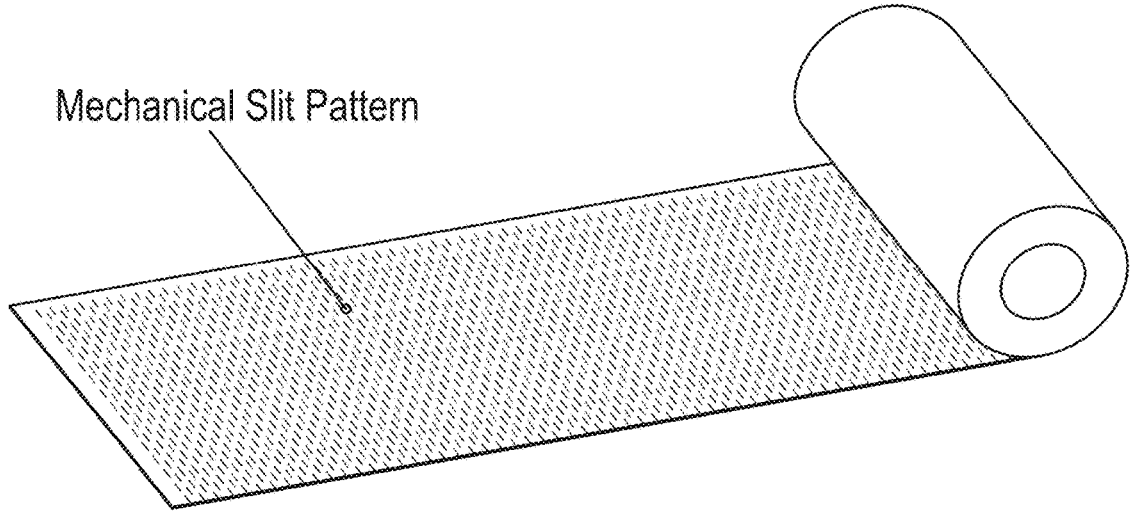
FIG. 11 (PRIOR ART)
FIG. 11 is an illustration of a prior art unidirectional composite prepreg fabric roll, where the composite prepreg fabric has a uniform, mechanically made slit pattern.
Figure 12:
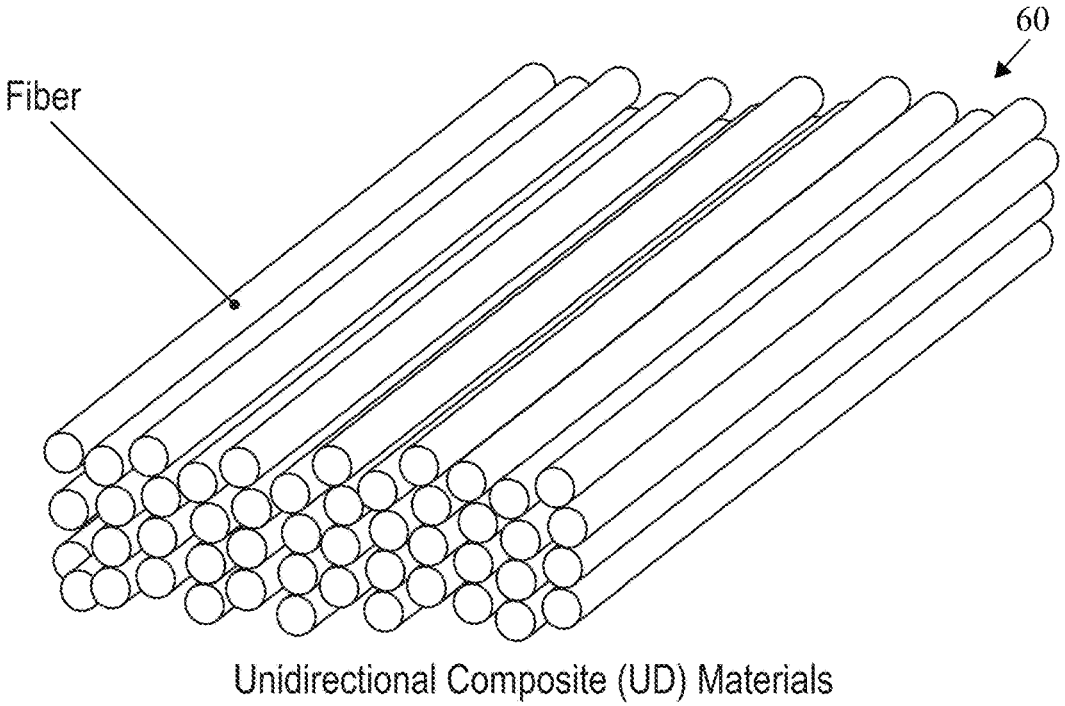
FIG. 12 (PRIOR ART)
FIG. 12 is an illustration of fiber orientation within a prior art unidirectional composite material.
Figure 13:
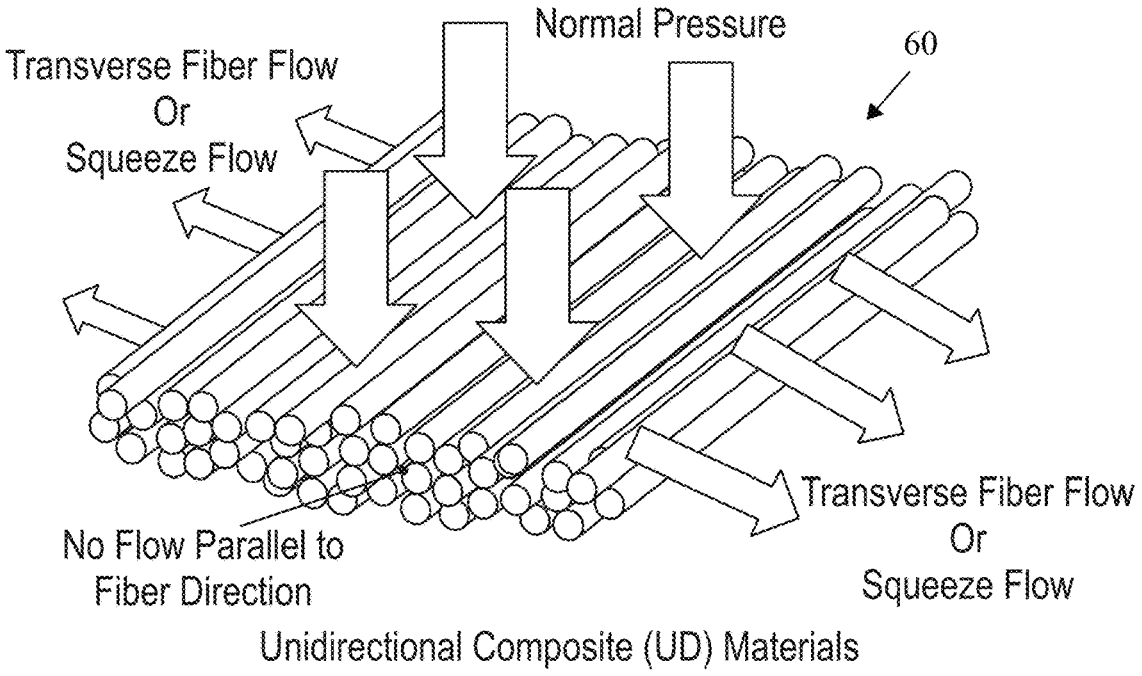
FIG. 13 (PRIOR ART)
FIG. 13 is an illustration of fibers shown in FIG. 12 subject to normal pressure and exhibiting transverse or squeeze fiber flow of a matrix resin as is understood in the prior art.
Figure 14:
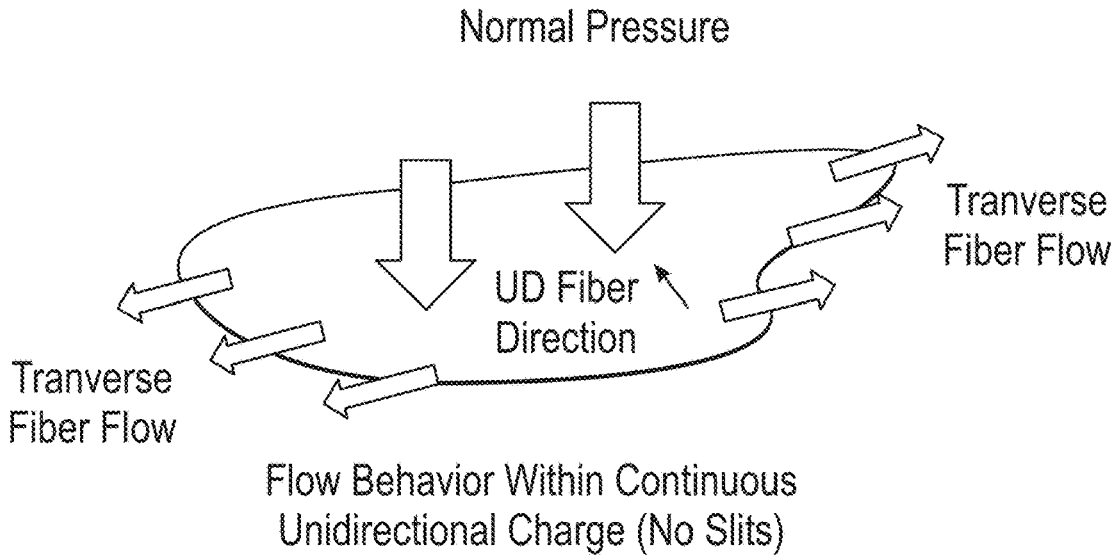
FIG. 14 (PRIOR ART)
FIG. 14 is an illustration of a prior art composite charge of unidirectional fiber, for a golf club head crown, where the charge has no slits and is therefore made up of continuous fibers, and where the charge is subject to normal pressure and exhibiting transvers fiber flow of a matrix resin.
Figure 15:
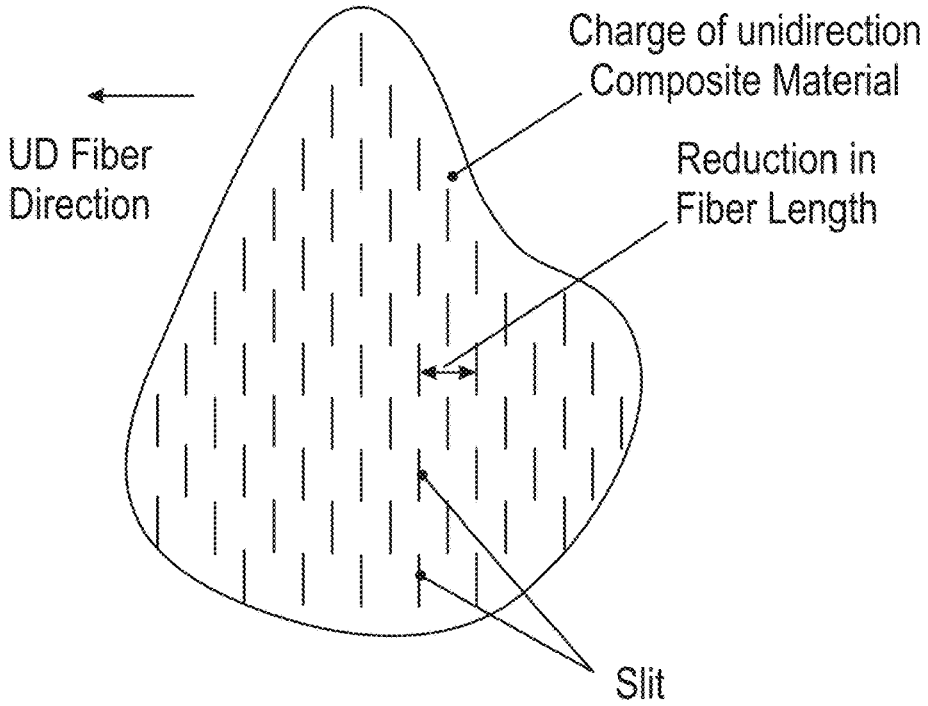
FIG. 15 (PRIOR ART)
FIG. 15 is an illustration of a prior art composite charge of unidirectional fiber, for a golf club head crown, where the charge has uniform, mechanically made slits reducing the fiber lengths and rendering the fibers discontinuous.
Figure 16:
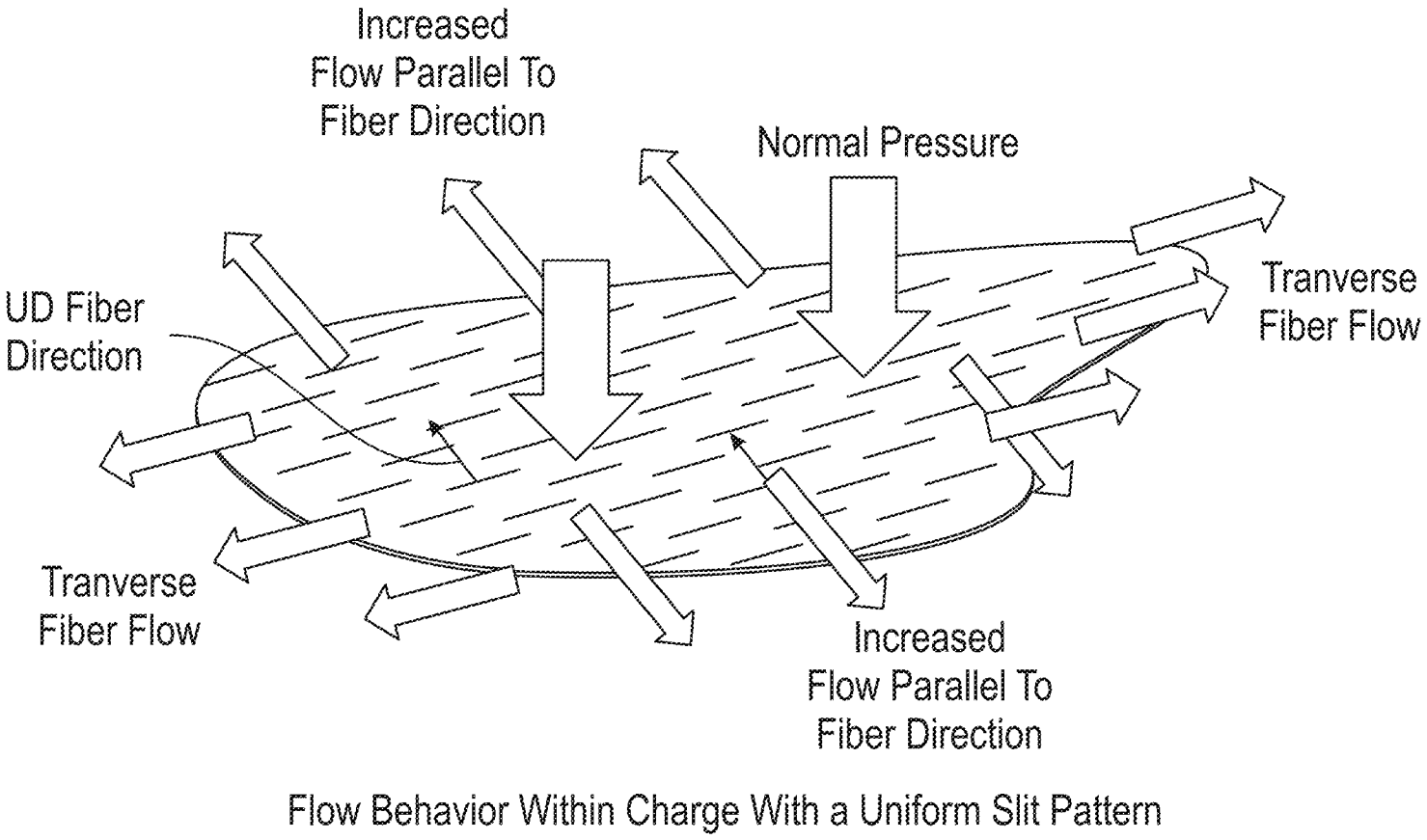
FIG. 16 (PRIOR ART)
FIG. 16 is an illustration of the prior art composite charge of FIG. 15 subject to normal pressure and exhibiting both transverse fiber flow and parallel fiber flow of the matrix resin.
Figure 17:
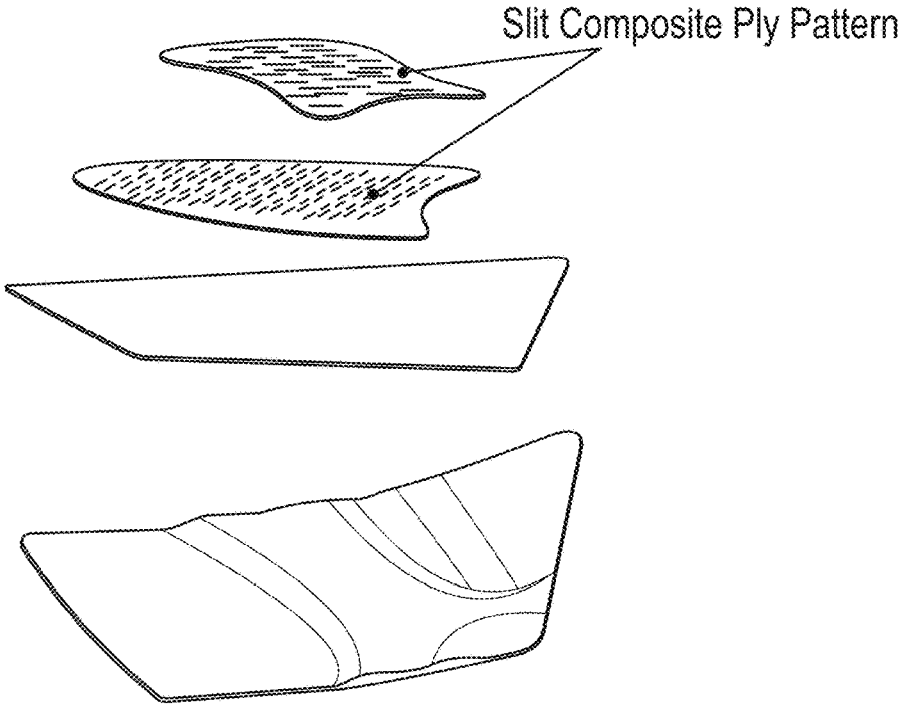
FIG. 17 (PRIOR ART)
FIG. 17 is an illustration of a prior art composite layup and resulting variable thickness golf club head sole using reinforcing fabric charges with uniform slit patterns.
Figure 18:
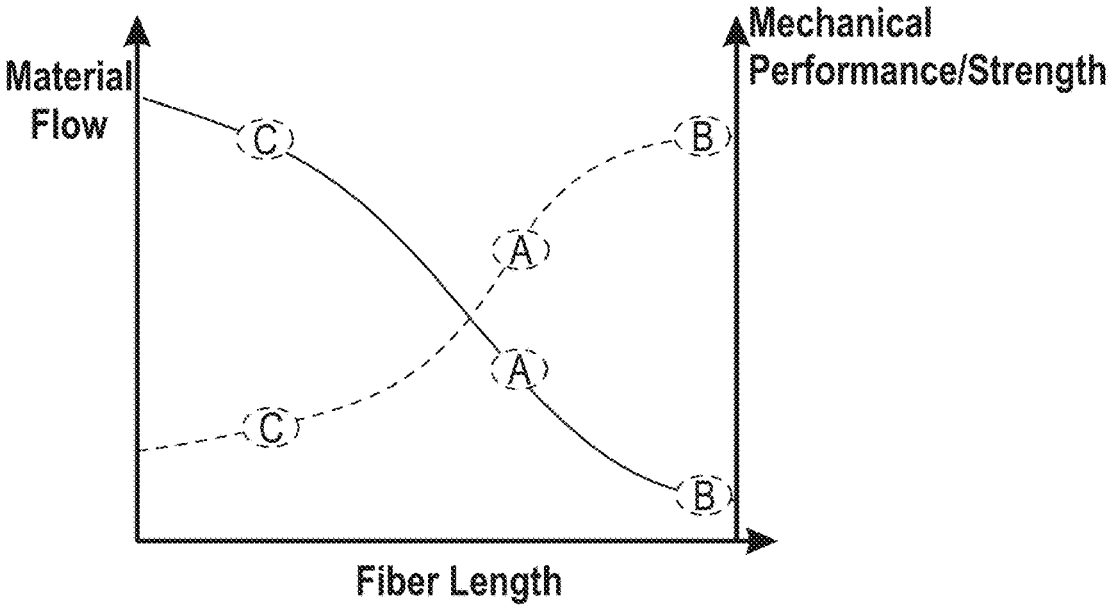
FIG. 18 (PRIOR ART)
FIG. 18 is a graph showing the known relationships between matrix resin material flow, fiber length, and mechanical performance/strength.
Figure 19:
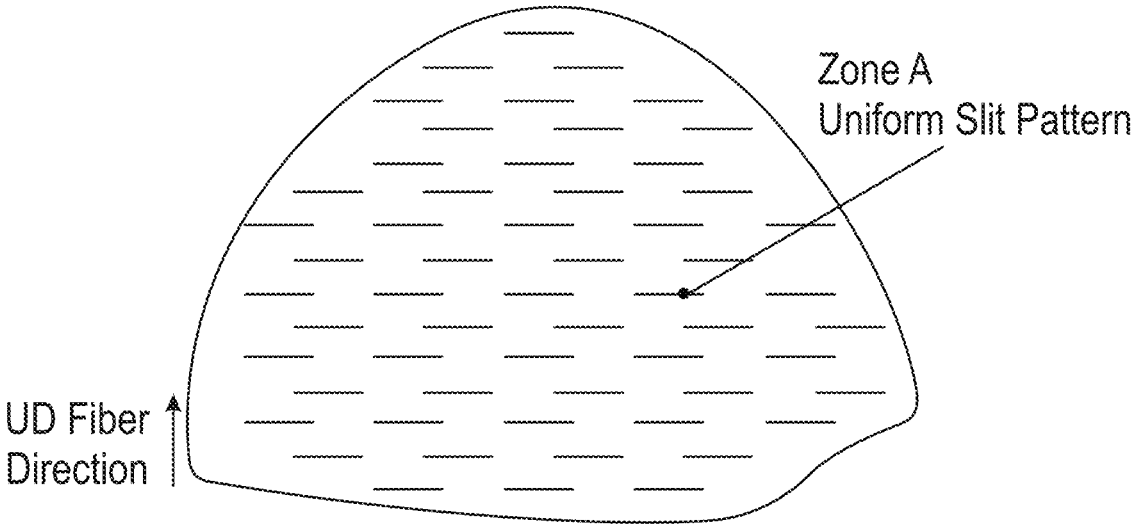
FIG. 19 (PRIOR ART)
FIG. 19 is an illustration of a prior art composite charge for a golf club head crown with a uniform, mechanically made slit pattern throughout the entire charge.
Figure 20:
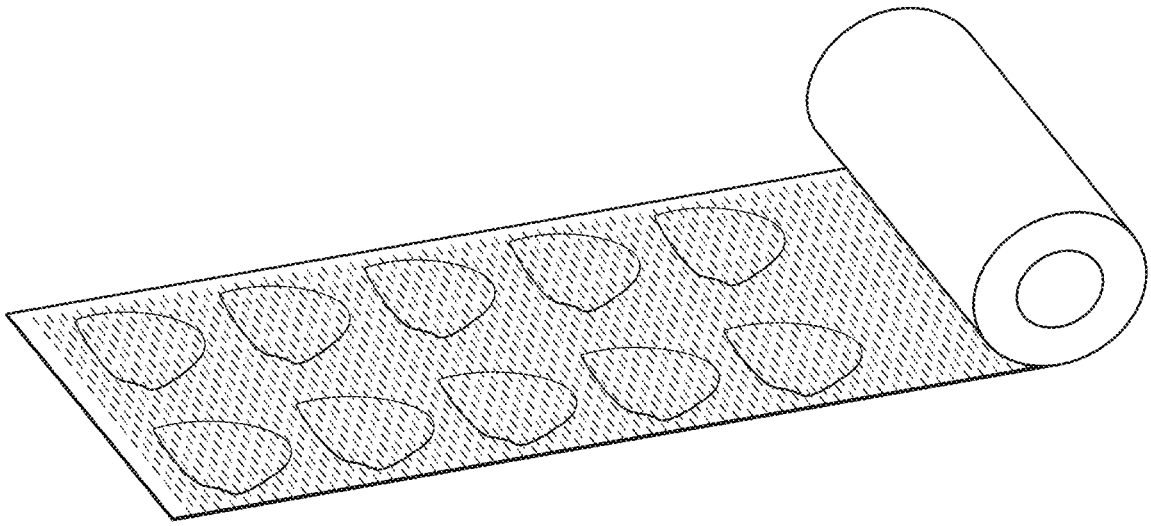
FIG. 20 (PRIOR ART)
FIG. 20 is an illustration of a roll of unidirectional fabric with a uniform, mechanically made slit pattern, and further illustrating the outlines for cutting multiple charges in the shape of the charge of FIG. 19.
Figure 21:
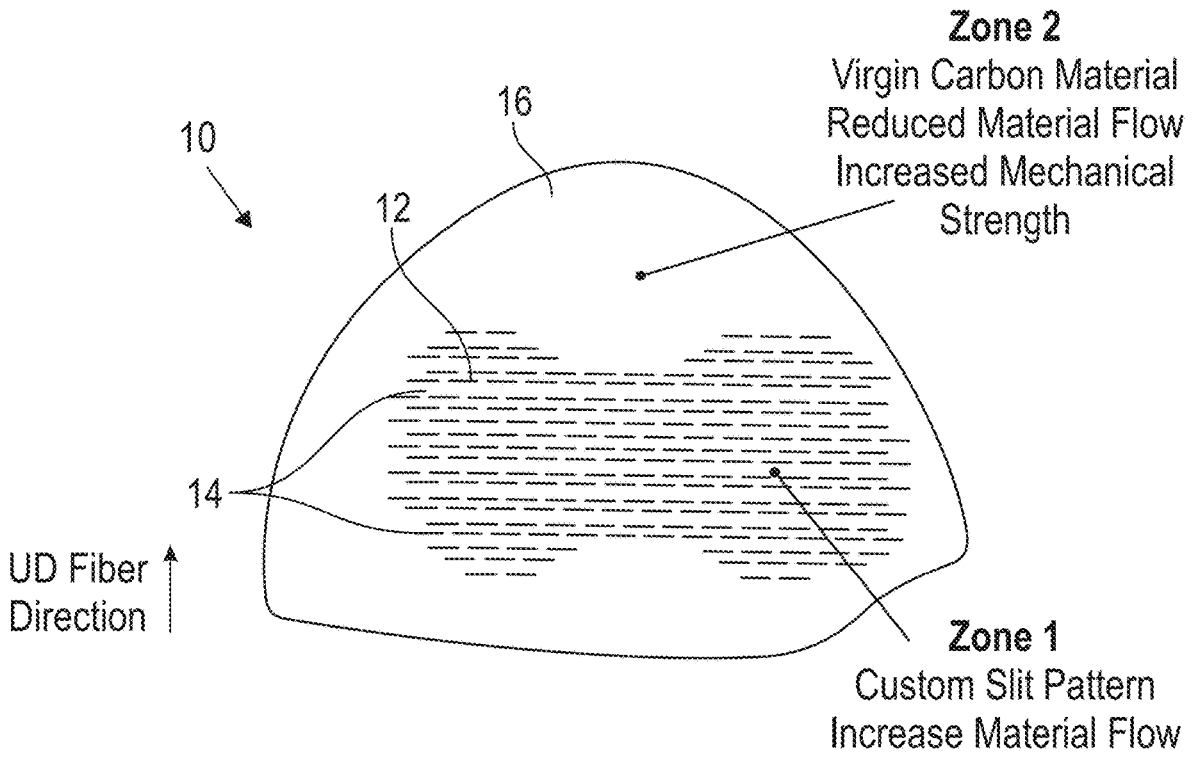
FIG. 21 is an illustration of a composite charge for a golf club head crown in accordance with the present disclosure, with a non-uniform slit pattern and indication of the zones of matrix resin flowability and differing mechanical strength created thereby.
Figure 30:
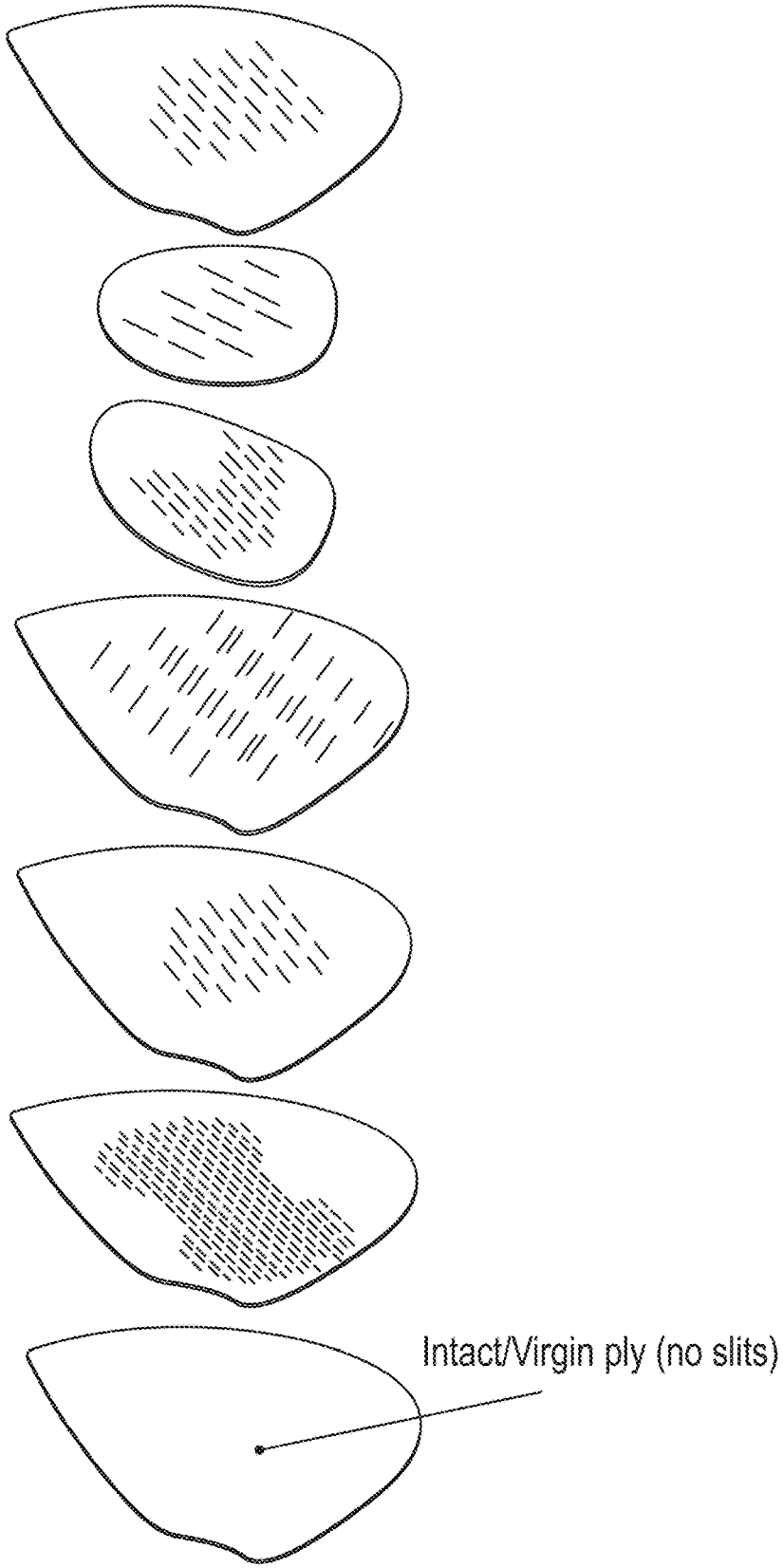
FIG. 30 is an exploded view of a layup of plies for manufacture of a golf club head crown, in accordance with the present disclosure, whereby different plies have different non-uniform slit patterns, or no slits at all, in order to modify and manipulate the matrix resin flow, thickness and material strength characteristics of the composite crown when cured.

With reference to FIG. 21, an exemplary embodiment of a single charge/ply 10 is illustrated. As explained herein, using a single ply 10 in accordance with this embodiment, a manufacturer can assemble a complete layup for application of matrix resin and curing into a unitary composite part, such as is illustrated in FIG. 30. The charge 10 may be of any known reinforcing fiber sheet, such as carbon, fiberglass, and aramid. The charge 10 has a fabric area weight of between 20 grams per square meter (gsm) and 500 gsm. The charge 10 may be of unidirectional fabric where the fabric tows (not shown in detail) are nonwoven and all oriented in the same direction. Alternatively, the charge 10 may be of woven multi-axial fabric, such as bi-axial, tri-axial, plain weave, braided, specialty weave, or any other reinforcing fiber fabric having the desired mechanical characteristics. The charge 10, as illustrated, may be a carbon unidirectional fiber, with the directionality as indicated in FIG. 21. The charge 10 may also be pre-preg.

The charge 10 has a first zone 12 in which the tows of the charge 10 have been cut with a plurality of slits 14 such that the tow in the first zone 12 are discontinuous. The plurality of slits 14 are configured in a non-uniform pattern that does not cover the entire surface area of the charge 10. The charge 10 also has a second zone 16 in which the tow in the second zone 16 are intact and continuous.

After layup using a charge 10 of the present embodiment, when uncured matrix resin is applied to the charge 10 (either by introduction of the uncured matrix resin under vacuum, or because it is already present in the case of pre-preg, and becomes flowable by application of heat), matrix resin will have increased flowability in the first zone 12. Specifically, the uncured matrix resin will flow in both a transverse direction to the directionality of the unidirectional fiber fabric, and it will also, to an extent, flow parallel to the directionality of the fibers, due to the custom slit pattern made in the first zone 12 creating discontinuous fibers. In the second zone 16, where the unidirectional fiber fabric has not been slitted, the matrix resin will flow only in the transverse direction as expected. As a result, given a normal and uniform pressure applied to the whole charge, more of the matrix resin will accumulate in the first zone 12 than in the second zone 16. When cured, this will result in the first zone 12 having a greater cross-sectional thickness than the second zone 16. This will also result in the first zone 12 having reduced mechanical strength, while preserving the expected level of mechanical strength in the second zone. 16.

The matrix resin that may be used include commercially available and known matrix resins, including but not limited to thermosetting resin, such as and including epoxy, polyester, and vinyl ester; or thermoplastic resin, such as and including nylon, polycarbonate, polyphenylene sulfide (PPS), polyetherketoneketone (PEKK), and polyetheretherketone (PEEK).

With reference to FIGS. 22-29 AND FIGS. 67-68, a variety of different embodiments of a single ply charge with a non-uniform pattern of slits are illustrated. Non-uniform slit patterns may be configured as needed to achieve the manufacturer's specified dimensions, geometry, and strength requirements for each ply of a variable thickness composite component. Non-uniform slit patterns may be, for example, oval-shaped, circular-shaped, kidney-shaped, S-shaped, or ring-shaped. The non-uniform slit patterns may also be offset from the center of the ply, or concentrated around the perimeter of the ply. As illustrated, the plurality of slits in the non-uniform patterns of slits can be straight line segments. The plurality of slits in the non-uniform pattern of slits can also be curves, chevrons, or multi-segmented. In certain embodiments, the curves have a minimum radius of curvature of 0.10 inches.

Figure 22:
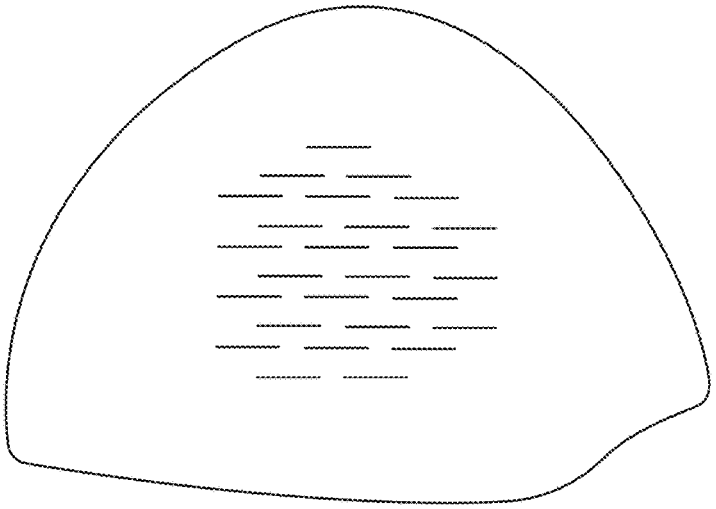
FIG. 22 is an illustration of another embodiment of a composite charge for a golf club head crown, with a non-uniform slit pattern, in accordance with the present disclosure.
Figure 23:
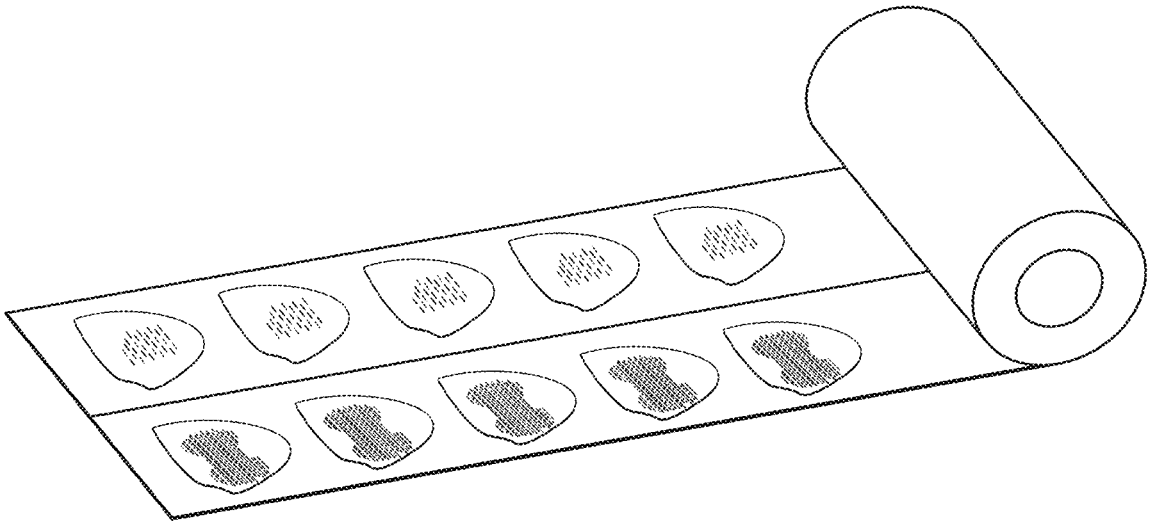
FIG. 23 is an illustration of a roll of unidirectional fabric with non-uniform slit patterns, and further illustrating the outlines for cutting multiple charges in the shape of the charges of FIGS. 21 and 22.
Figure 24:
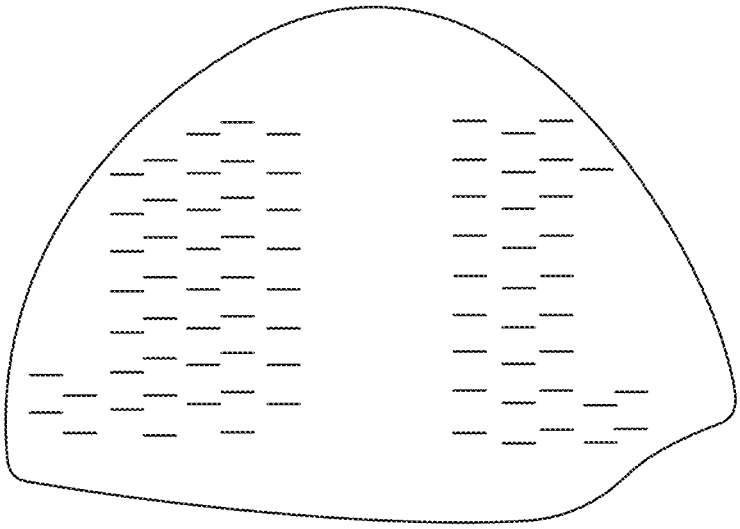
FIGS. 24-29 are illustrations of other embodiments of a composite charge for a golf club head crown, each with a different non-uniform slit pattern, in accordance with the present disclosure.
Figure 25:
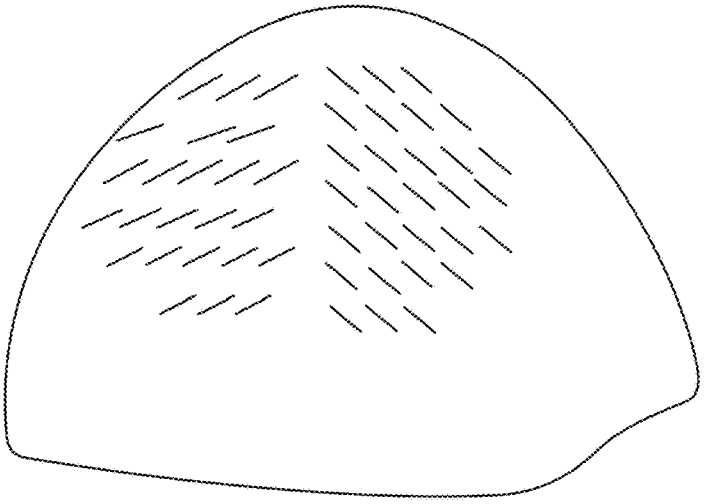
Figure 26:
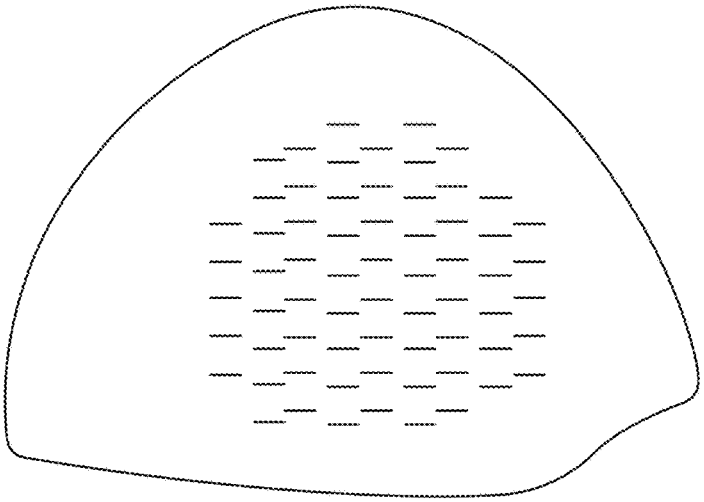
Figure 27:
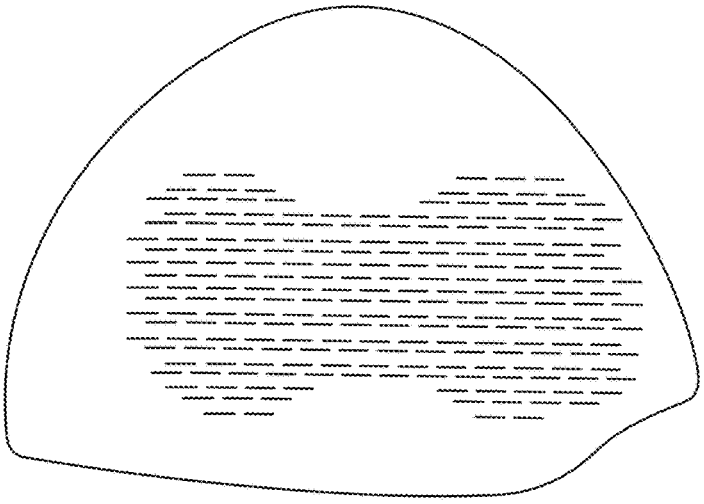
Figure 28:
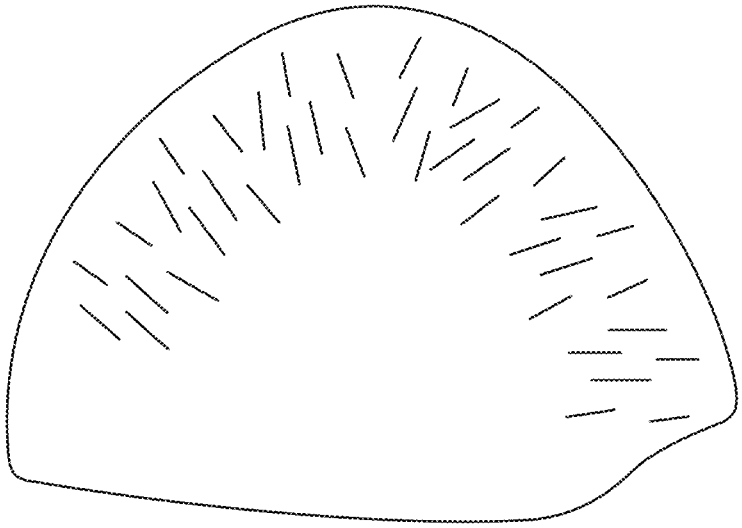
Figure 29:
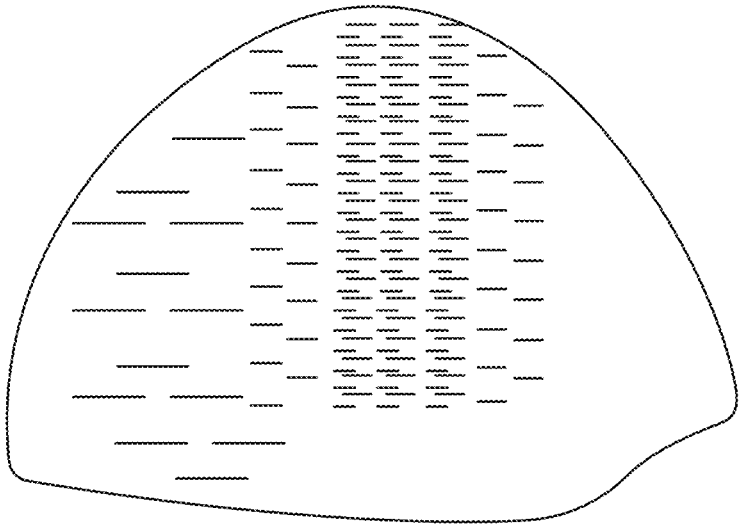

With reference to FIG. 23, a manner in which the exemplary charges of FIGS. 21 and 22, with their respective non-uniform patterns of slits, may be procured from a standard roll of unidirectional pre-preg fabric.

Figure 31:
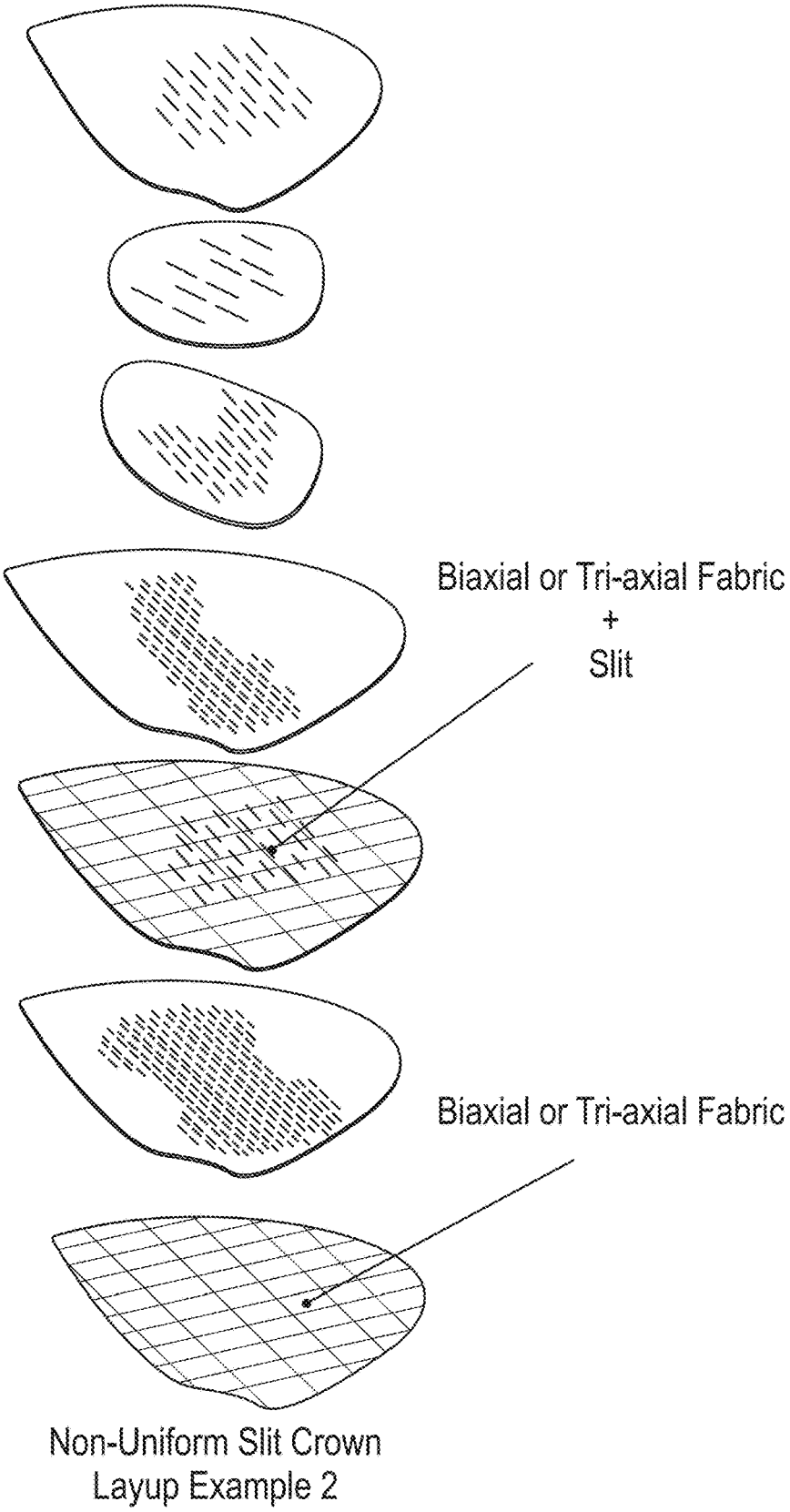
FIG. 31 is an exploded view of another embodiment of a layup of plies for manufacture of a golf club head crown, in accordance with the present disclosure, whereby different plies have different non-uniform slit patterns, or no slits at all, in order to modify and manipulate the matrix resin flow, thickness and material strength characteristics of the composite crown when cured.

With reference to FIGS. 30 and 31, two different exemplary embodiments of complete layups for a golf club head composite crown are provided. As illustrated, in order to achieve the desired thicknesses, geometry, and strength requirements for the composite crown, a number of charges, each with a customized non-uniform pattern of slits, or no slits at all, are used. Moreover, it should be noted that different types of reinforcement fabric, with different directionalities, may be used as needed to achieve requirements.

Figure 32:
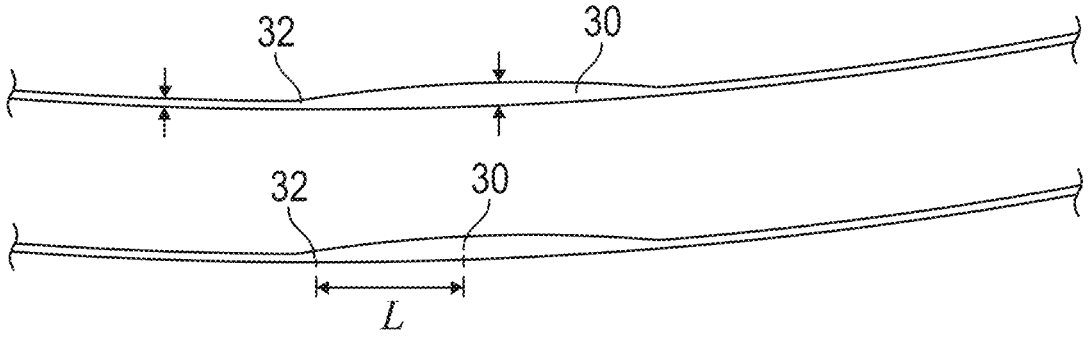
FIG. 32 is an annotated cross-sectional view of a variable thickness composite golf club head crown made in accordance with the present disclosure, the annotations as to certain measurement points and distances.
Figure 33:
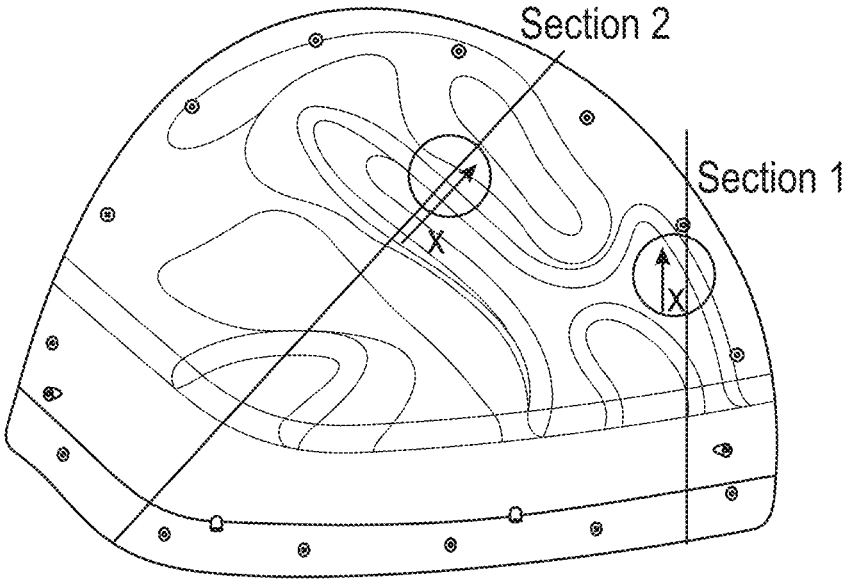
FIG. 33 is an illustration of the variable thickness composite golf club head crown of FIG. 32, with indications of the locations and extent of the cross-sectional views of FIG. 32.

With reference to FIGS. 32-33, variable thickness composite parts that are believed to be are achievable using the embodiments of the present disclosure are shown. As shown in FIG. 32, the cured unitary composite has a varying thickness. This varying thickness composite component will have its thickest point 30, which will correspond to at least one—and perhaps several—of the first zones of the charges in the layup. The varying thickness composite component will also have its thinnest point 32. In some cases, this will be the "normal" thickness that is achievable with continuous fibers present in one or more second zones of the laid-up charges. The component will also have a length L between these points 30 and 32.

In some embodiments, depending on the amount of pressure applied, there will be a transition in thickness from the first zone to the second zone. In some embodiments, this transitional sloping zone establishes a third transitional zone, between the first zone and the second zone, in which the third transitional zone has a third cross-sectional thickness that is less than the first zone cross-sectional thickness but greater than the second zone cross-sectional thickness.

Using the embodiments disclosed herein, a component thickness variation is defined as the difference between the second thickness and the first thickness. Component thickness variation can vary between 0.010 inch and 0.50 inch.

As illustrated in FIG. 32, the golf club head composite crown also includes a dimension L defined as the length between the first point 30 and the second point 32. Exemplary values for dimension L range between 0.010 inch and 0.50 inch. From this, a thickness rate of change is defined as the rate of change along the cross-section of the component, and which is defined by the formula:

$$\text{Thickness rate of change} = \frac{\text{Second Thickness} - \text{First Thickness}}{L}$$

Using the techniques of the present disclosure, an achievable thickness rate of change is in a range between 0 in/in and 5 in/in.

Still further, a component thickness rate of change is defined as the rate of change along the cross-section of the component and is defined by the formula:

$$\text{Thickness}_{Change} = \lim_{h \to 0} \frac{\text{Thickness}(x+h) - \text{Thickness}(x)}{h}$$

where the component thickness rate of change is in a range between 0 in/in and 5 in/in.

From this, an area charge is defined as the surface area of the first ply, a cut length is defined as the length of each of the plurality of slits, where n is defined as the exact number of slits of the pattern of slits in the ply, a cut ply ratio is defined by the formula:

$$\text{Cut_Ply_Ratio} = \frac{\left(\sum_{k=1}^{n} \text{Cut_Length}_k\right)}{\text{Area}_{Charge}}$$

and;

Using the techniques of the present disclosure, an achievable cut ply ratio is between 0.1 in/in$^2$ and 100 in/in$^2$. In a further embodiment, the cut length varies between 0.020 inch and 2.00 inches.

In a further embodiment a number m is defined as the total number of plies in the plurality of plies of a layup, a number n is defined as the total number of slits per ply m; where a cut layup ratio is defined by the formula:

$$\text{Cut}_{Layup_{Ratio}} = \frac{\left(\sum_{k=1}^{m} \sum_{k=1}^{n} (\text{Cut_Length}_k)\right)}{\sum_{k=1}^{m} \text{Area}_{charge_k}}$$

and;

Using the techniques of the present disclosure, an achievable cut layup ratio varies in a range between 0.05 in/in$^2$ and 200 in/in$^2$.

Figure 34:
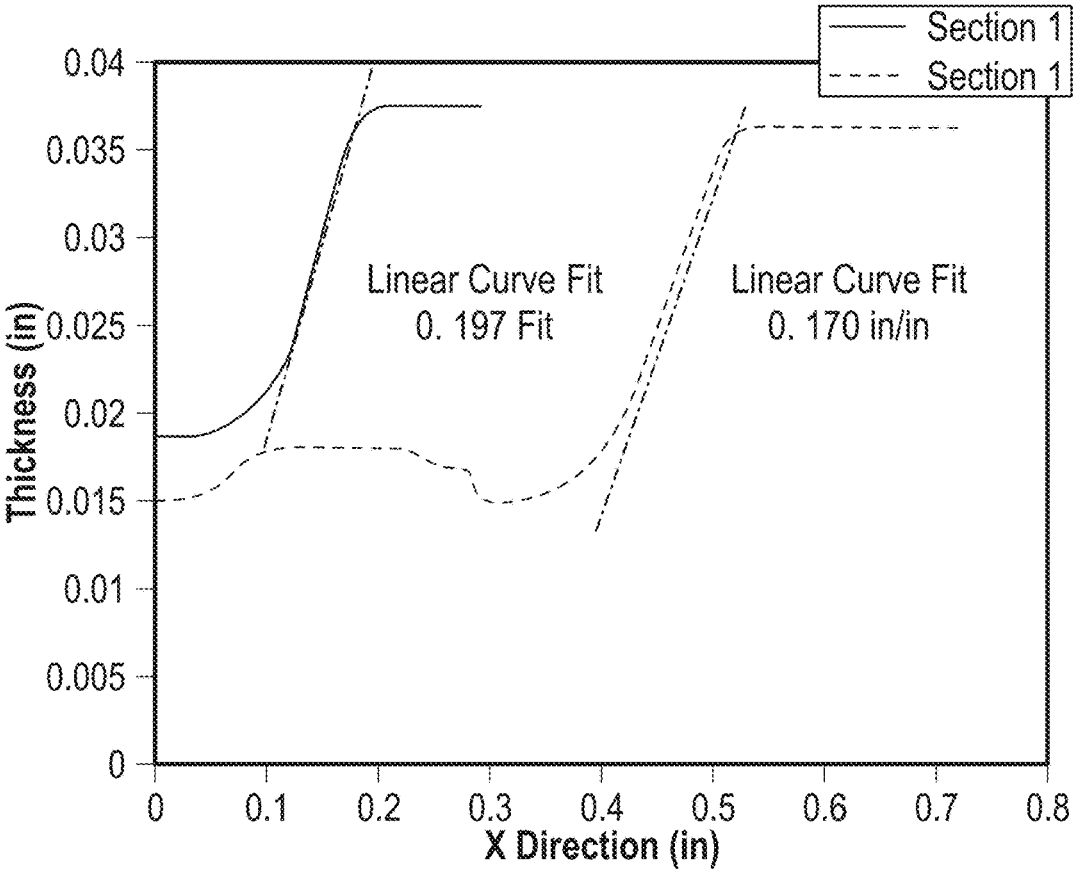
FIG. 34 is a graph showing thickness changes of the composite golf club head crown of FIG. 32.
Figure 35:
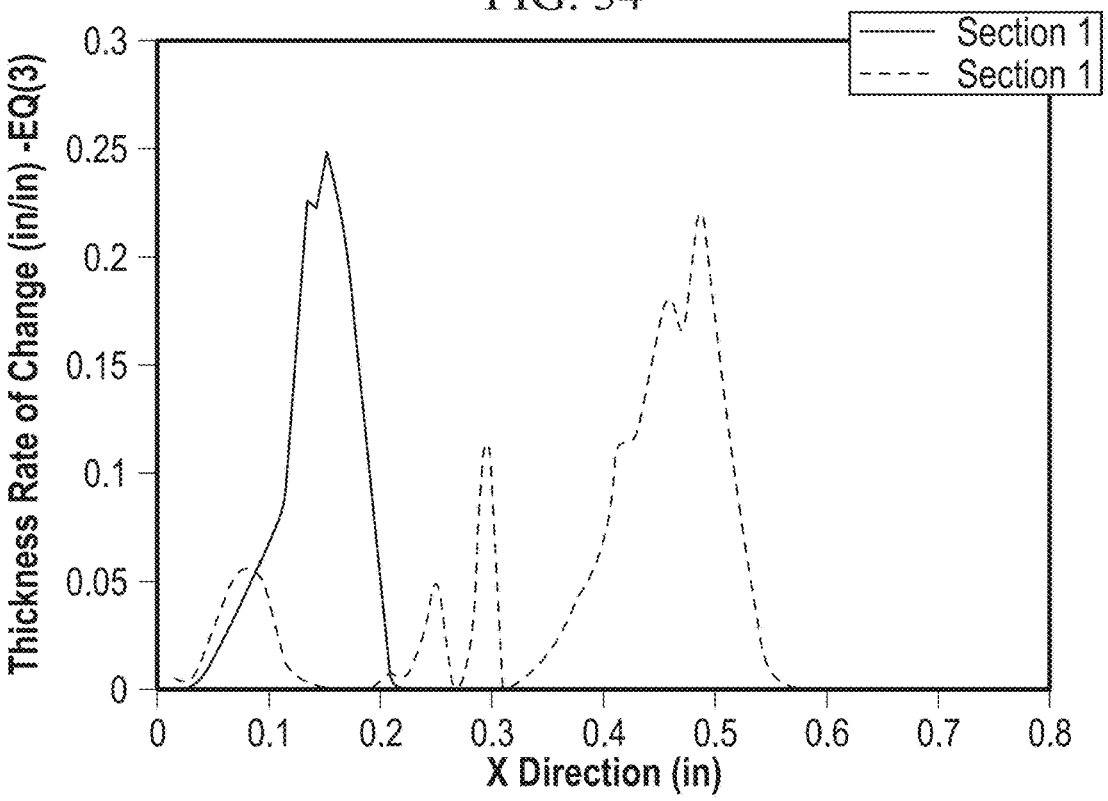
FIG. 35 is a graph showing the thickness rate of change in inches/inch of the composite golf club head crown of FIG. 33.
Figure 36:
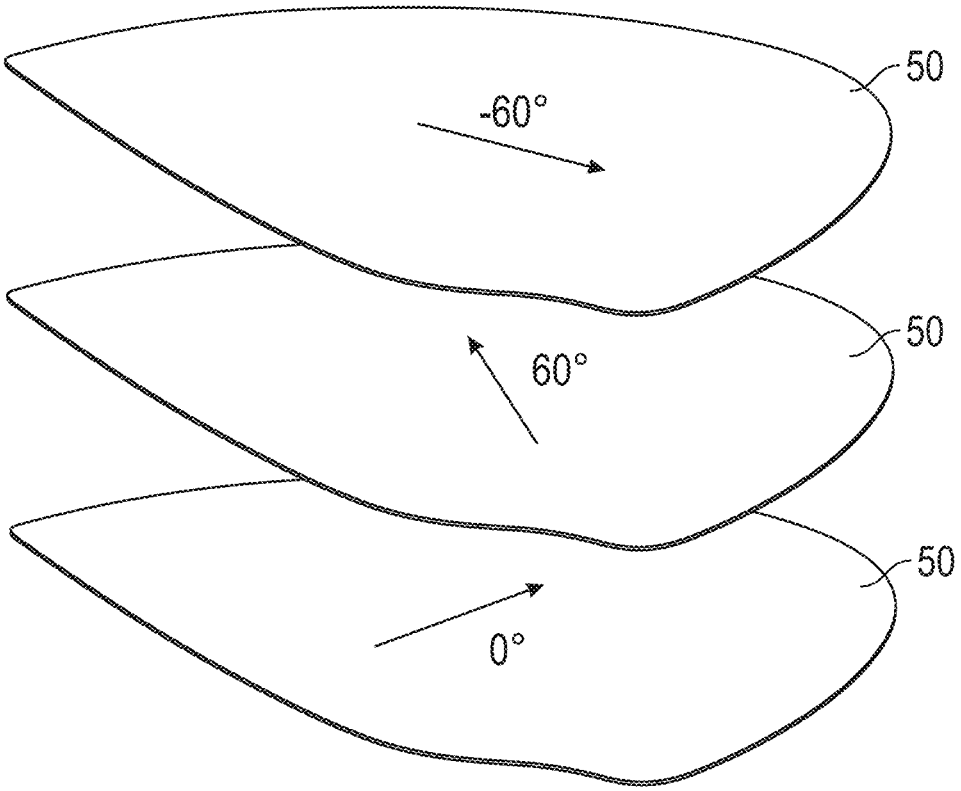
FIG. 36 is an exploded view of another embodiment of a layup of unidirectional plies for manufacture of a golf club head crown, in accordance with the present disclosure, indicating the directionality of each of the charges, prior to the cutting of the non-uniform pattern of slits.
Figure 37:
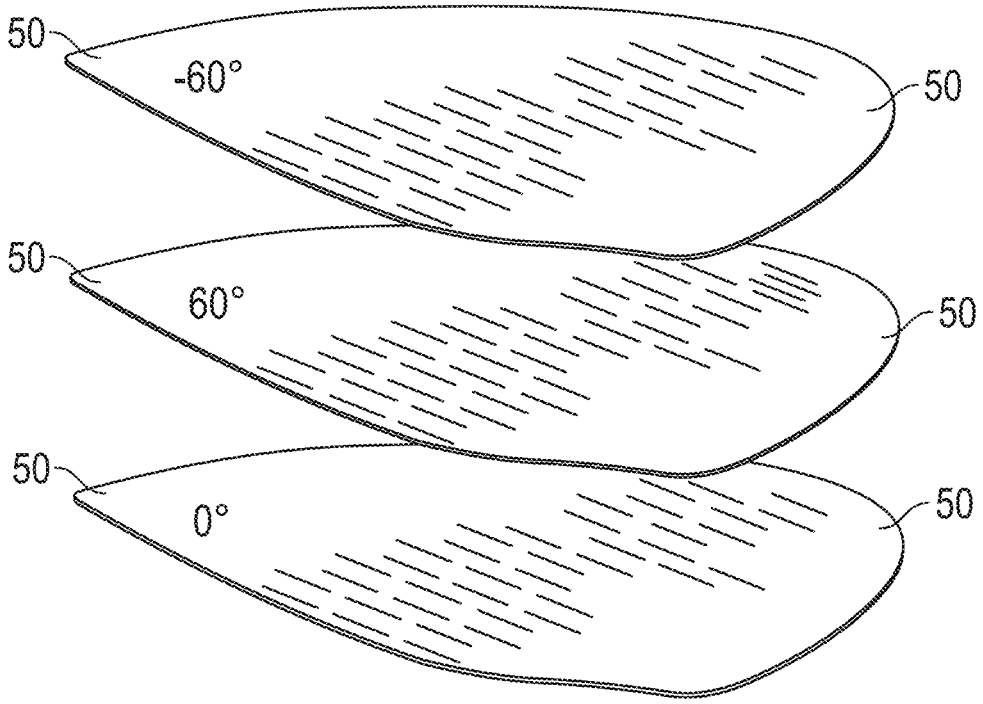
FIG. 37 is an exploded view of the layup of FIG. 36, after a non-uniform pattern of slits has been cut into each of the three charges.
Figure 38:
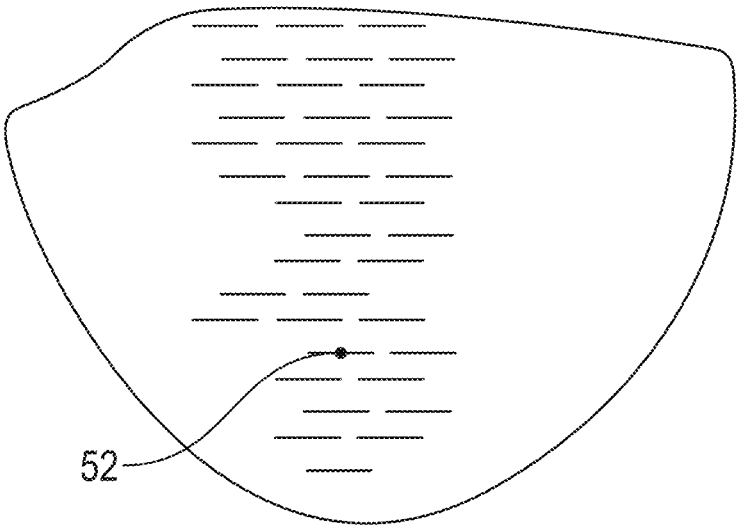
FIG. 38 is a top view illustration of the non-uniform slit pattern on the layup of charges of FIGS. 36-37, and exemplifying how a single cutting stroke can cut the same non-uniform slit pattern in a stack of charges when their directionality is correctly oriented prior to applying the cutting stroke.

These formulas are illustrated in use in a practical application in FIGS. 34-35, when addressing cross-sectional thickness variations in the embodiment shown in FIGS. 32-33.

Figure 39:
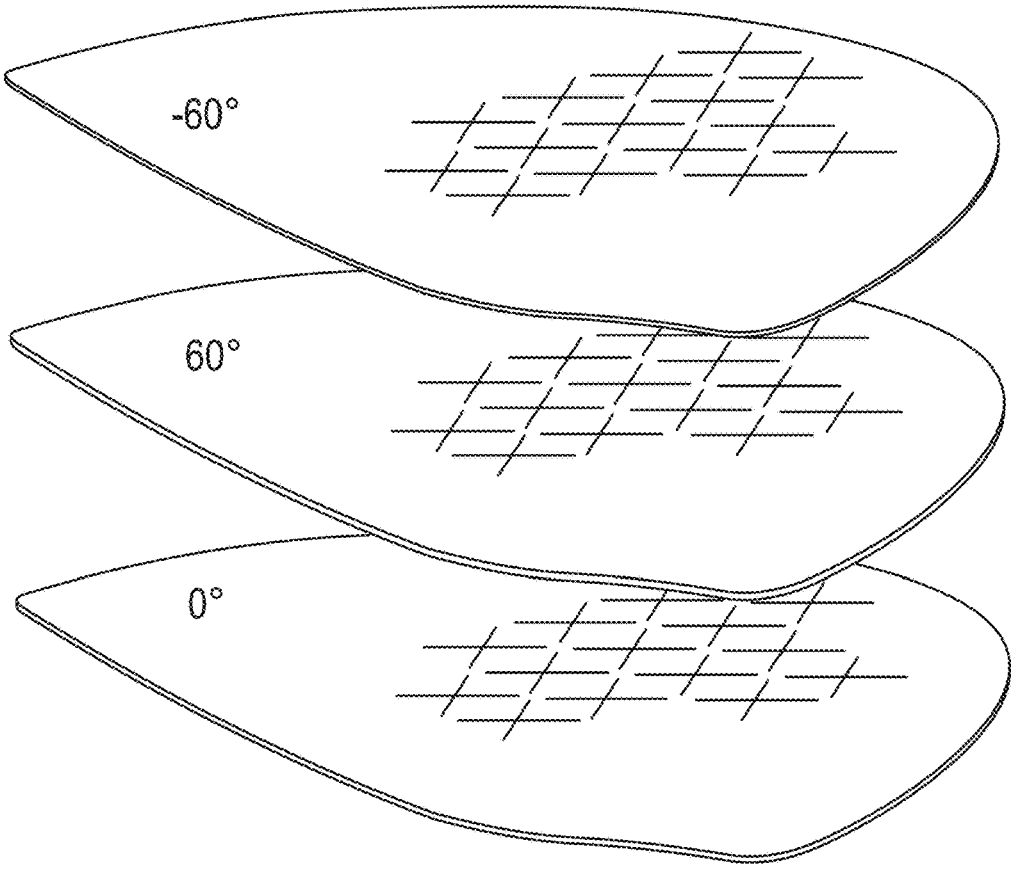
FIG. 39 is an exploded view of the layup of FIG. 36, after an alternative cross-hatch, non-uniform pattern of slits has been cut into each of the three charges.
Figure 40:
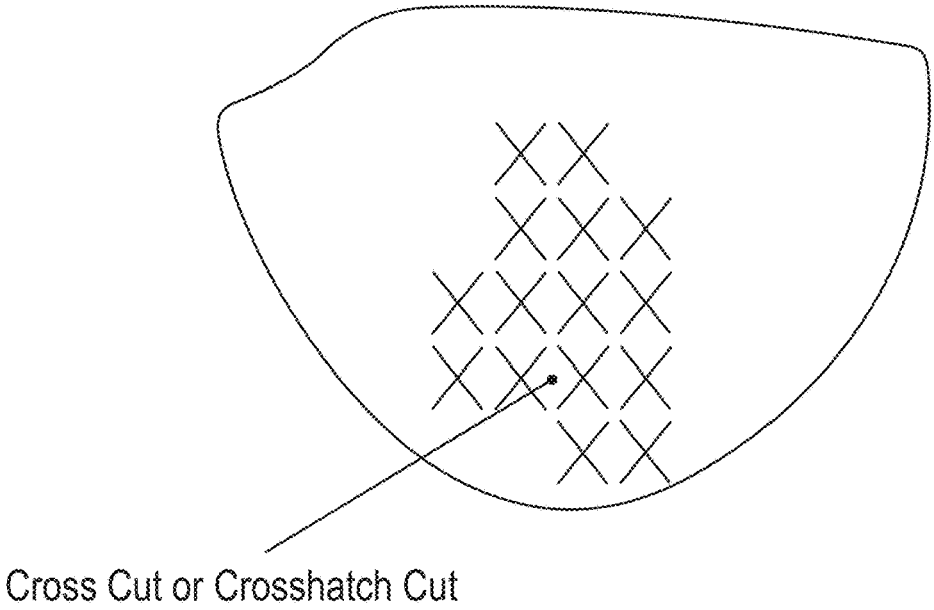
FIG. 40 is a top view illustration of the non-uniform slit pattern on the layup of charges of FIG. 39, and exemplifying how a single cutting stroke can cut the same non-uniform crosshatch slit pattern in a stack of charges when their directionality is correctly oriented prior to applying the cutting stroke.

With reference to FIGS. 36-40, prior to layup, multiple charges 50 can be selected and oriented with respect to their directionality, and a single stroke or actuation of a cutting mechanism can be used to cut a non-uniform pattern of slits 52 into the stack of charges 50. This is true even with respect to unidirectional fabrics, so long as the directionality is known and properly oriented prior to application of a cutting stroke. Conversely, if a stack of charges 50 is stacked in a way that the directionality of each charge is unknown, or incorrectly oriented, then it is possible that the cutting tool (whether a blade, sonic knife, laser, etc.) will orient the slits along an axis that is parallel to the fiber directionality of the unidirectional fabric, and accordingly, no fibers- or at least very few fibers-will be cut, leaving the fibers (or tows) of the charge mostly continuous. Alternatively, a crosshatch slit shape can be employed, as illustrated in FIGS. 39-40, which will ensure that slits are cut regardless of fabric directionality.

Figure 41:
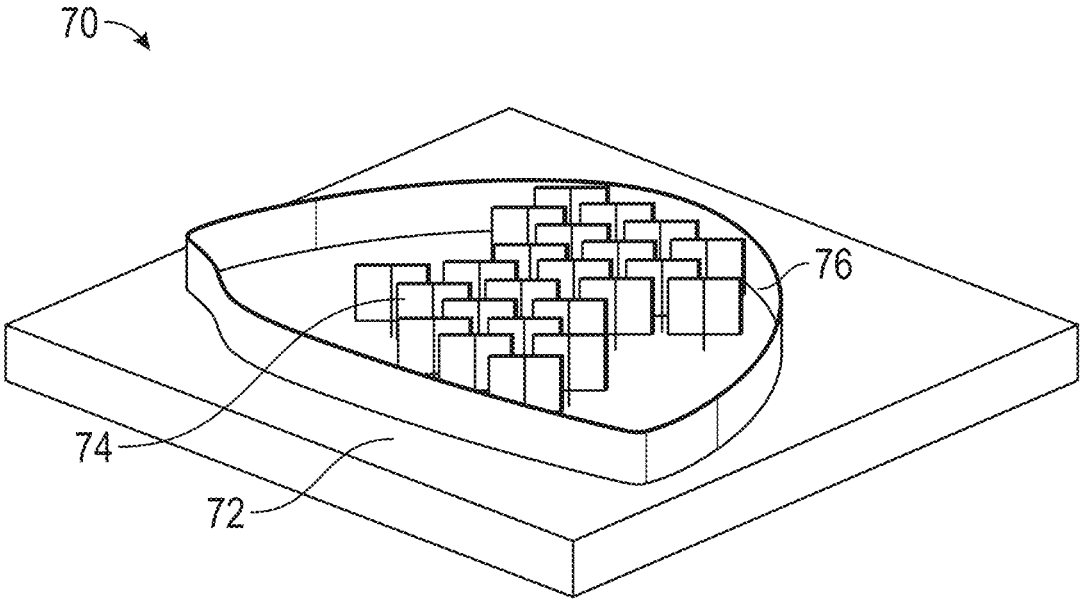
FIGS. 41-42 are illustrations of slit die board designs in accordance with the present disclosure.
Figure 42:
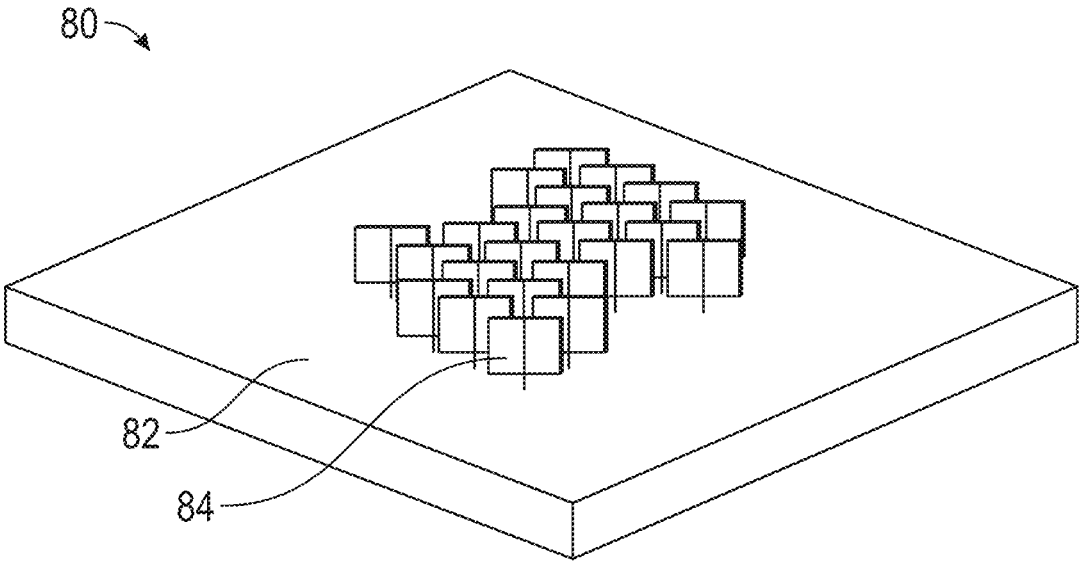

With reference to FIGS. 41-42, slit-die boards for cutting charges with non-uniform patterns of slits, or for simply cutting non-uniform patterns of slits, are provided. With reference to FIG. 41, a slit die board 70 is provided and includes a backer board 72, a plurality of pattern blades 74 affixed to the backer board 72 in a desired pattern, and a charge perimeter cutting blade 76 in the shape of the desired charge. This slit die board 70 can be used by hand, or more preferably, it can be attached to a mechanical press with a field for positioning and securing one or more reinforcement fiber plies, so that upon actuation of the mechanical press the slit die board 70 is brought into proximity of the field, such that the plurality of pattern blades 74 will cut slits into the one or more reinforcement fiber plies and the charge perimeter cutting blade 76 will cut the shape of the charge in a single cutting stroke.

With reference to FIG. 42, a slit die board 80 is provided and includes a backer board 82, and a plurality of pattern blades 84 affixed to the backer board 82 in a desired pattern. This slit die boar 80 does not have a charge perimeter cutting blade. Similar to the above, this slit die board 80 can be used by hand, or more preferably, it can be attached to a mechanical press with a field for positioning and securing one or more reinforcement fiber plies, so that upon actuation of the mechanical press the slit die board 80 is brought into proximity of the field, such that the plurality of pattern blades will cut slits into the one or more reinforcement fiber plies.

Alternatively, though not shown, the step of cutting the pattern of slits in the charges may be performed by programming an automated cutting table to cut the pattern of slits.

Figure 43:
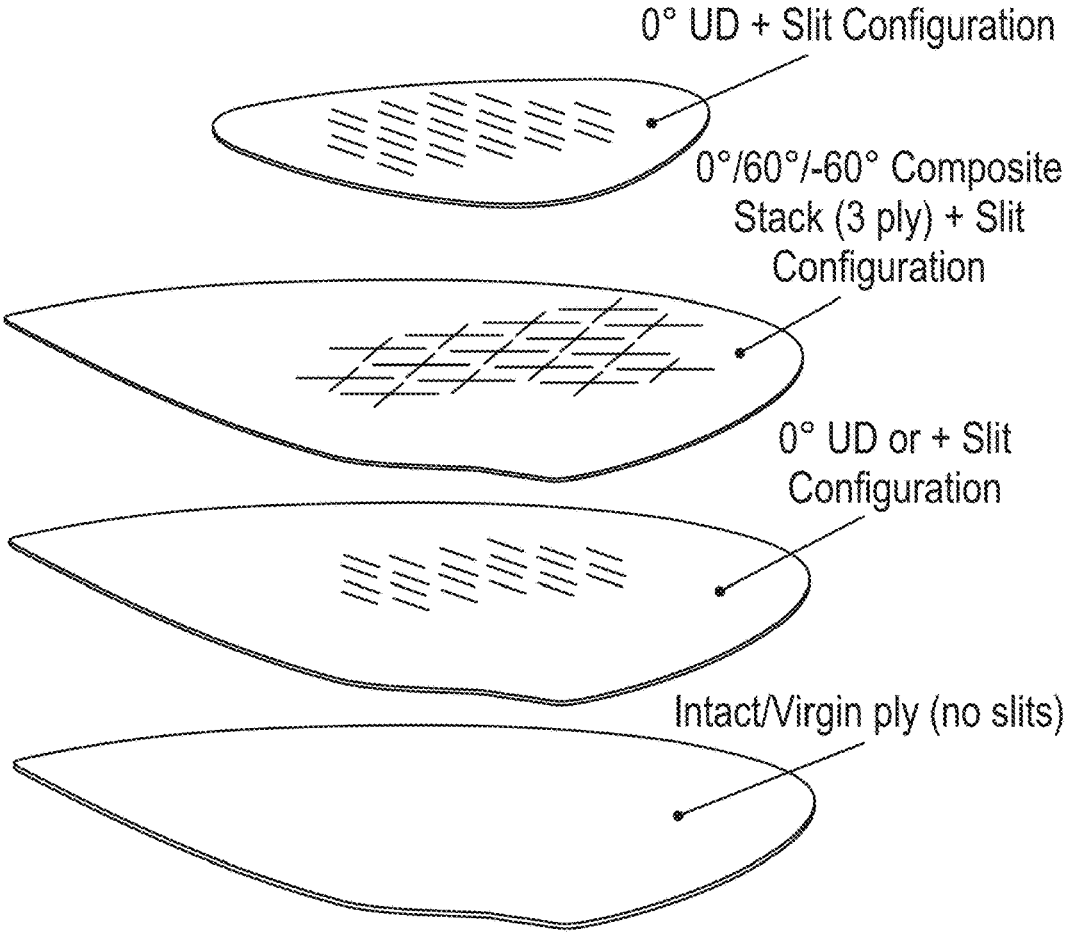
FIG. 43 is an exploded view of another embodiment of a layup of unidirectional plies for manufacture of a variable thickness golf club head crown, in accordance with the present disclosure, indicating the directionality of each of the charges, and the non-uniform slit pattern cut in each charge, or that no slit pattern is cut, in order to modify the matrix resin fluid flow, thickness and material strength according to desired performance characteristics.

With reference to FIG. 43, an exemplary layup for a golf club head composite crown, in accordance with the above disclosure, is shown. As illustrated, the layup has multiple plies, of different fabrics, placed in different orientations as to directionality, and each ply has a different non-uniform pattern of slits cut with respect to the directionality of the charge. In the case of the bottom charge, it is intact and has no slits. The number of plies may vary between 2 and 50.

Figure 44:
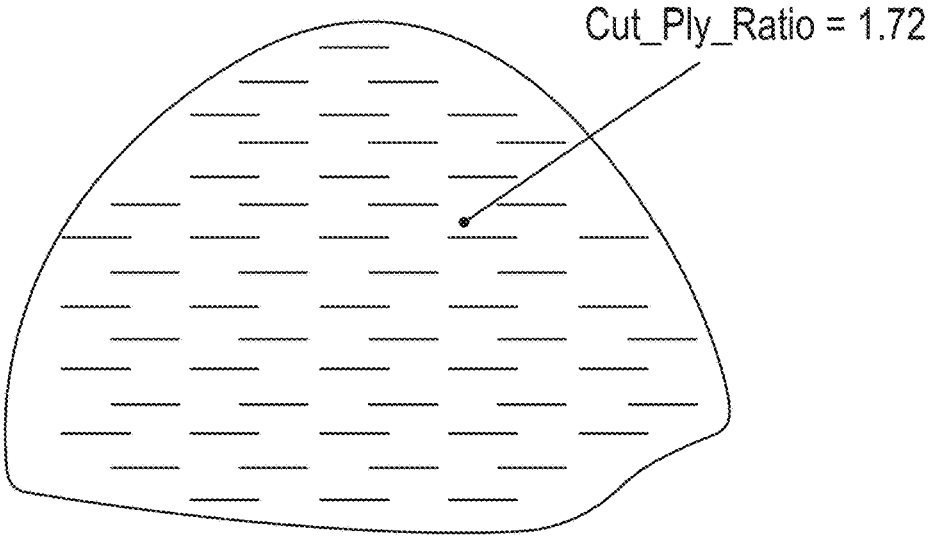
FIGS. 44-46 are top view illustrations of exemplar slit patterns resulting in different cut-ply ratios.
Figure 45:
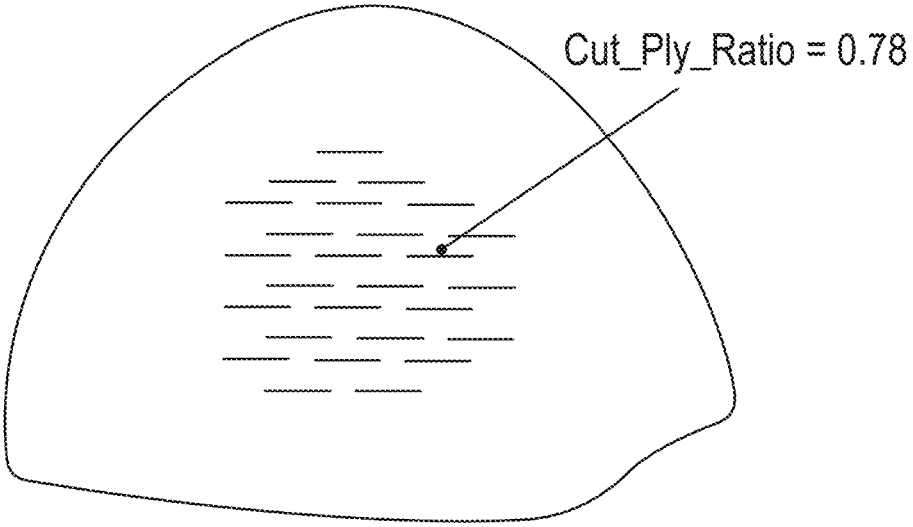
Figure 46:
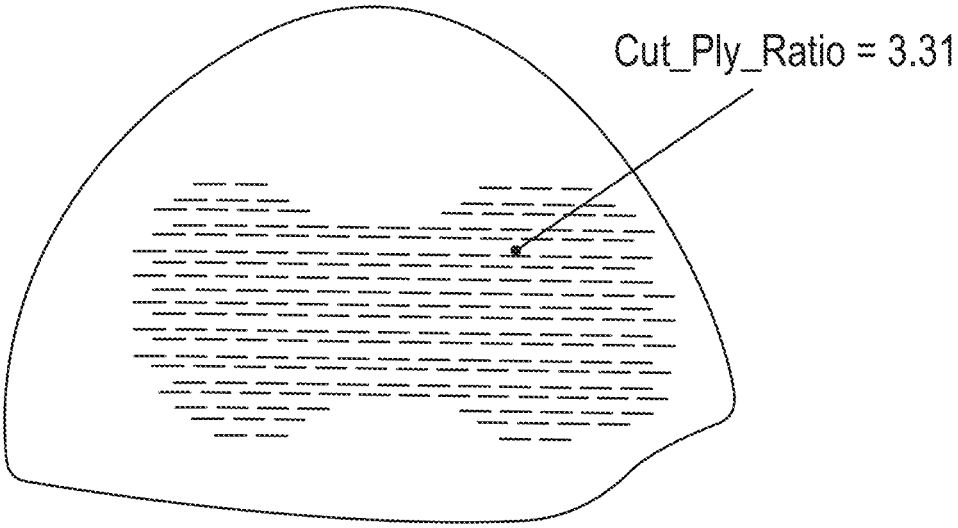
Figure 47:
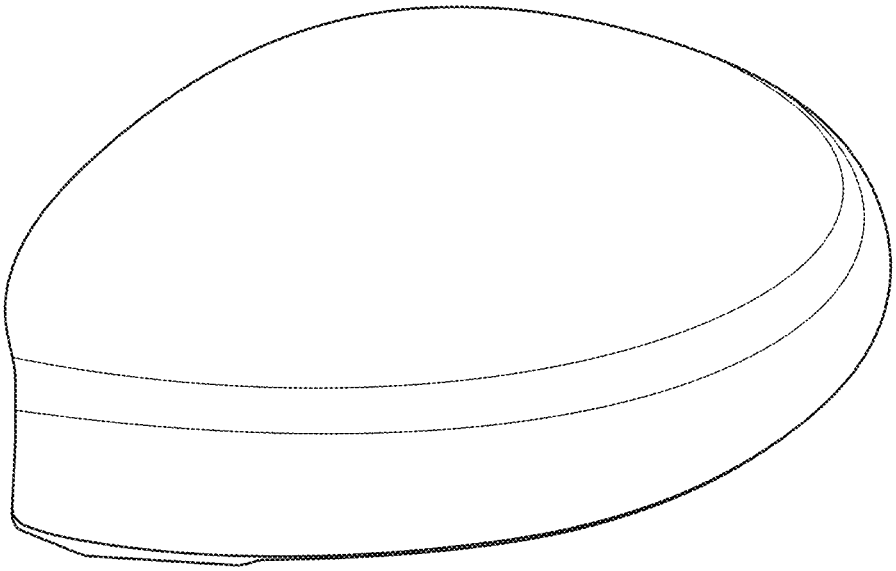
FIGS. 47-48 are illustration of exemplar variable-thickness golf club sole components resulting from different patterns of non-uniform slits in the composite layup, with indications of thicknesses in multiple dimensions.
Figure 48:
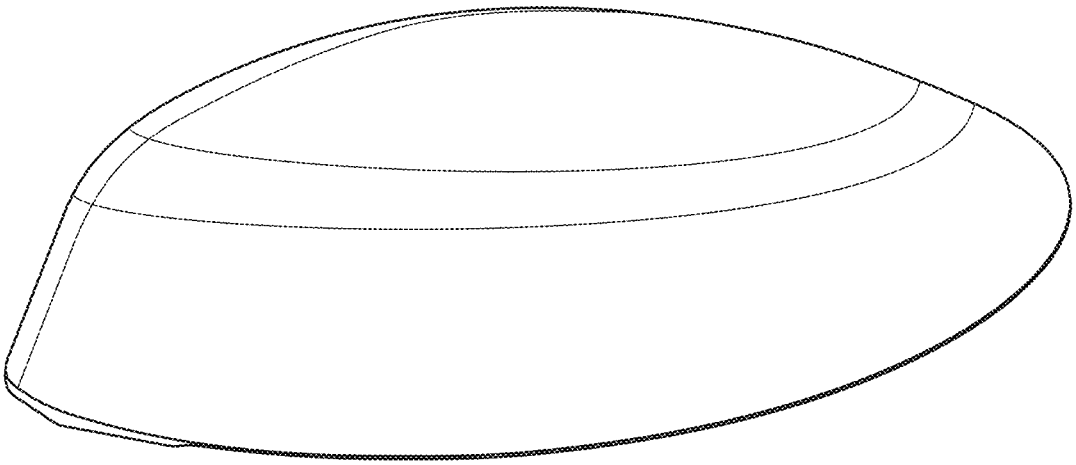

With respect to FIGS. 44-46, different sizes and density of slits can result in different cut-ply ratios. As explained, varying the cut-ply ratios can enable finer control of the penetration of the resin matric through the fabric ply, and therefore enable finer control of the resultant thickness of the cured composite part. With respect to FIGS. 47-48, examples of variable-thickness golf club sole components resulting from different patterns of non-uniform slits in the composite layup, with indications of thicknesses in multiple dimensions are provided.

Figure 49:
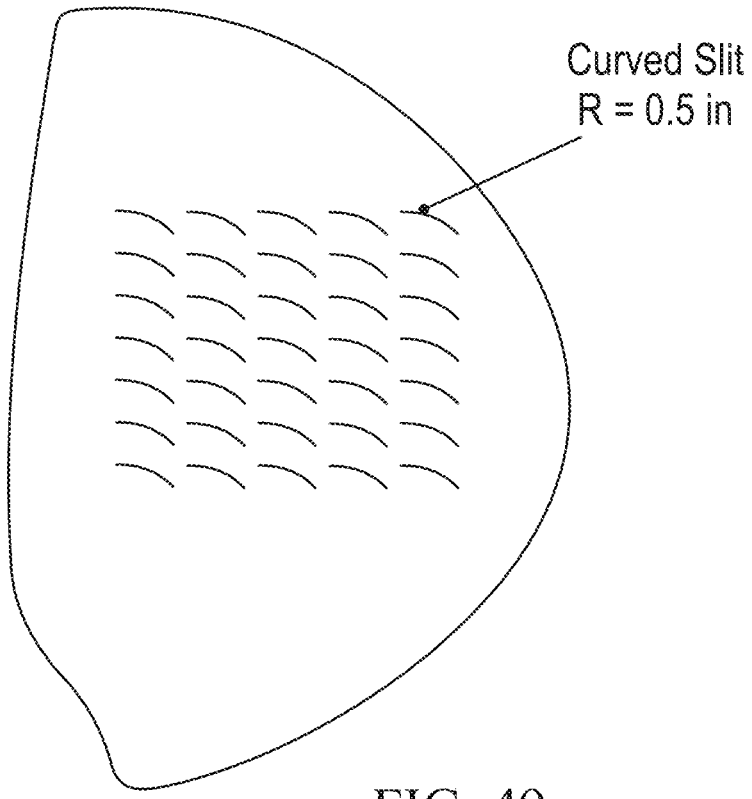
FIG. 49 is a top view of a ply with a non-uniform slit pattern, where the slits are curved.

With respect to FIG. 49, an exemplar of a ply with a non-uniform slit pattern, where the slits are curved, is provided.

Figure 50:
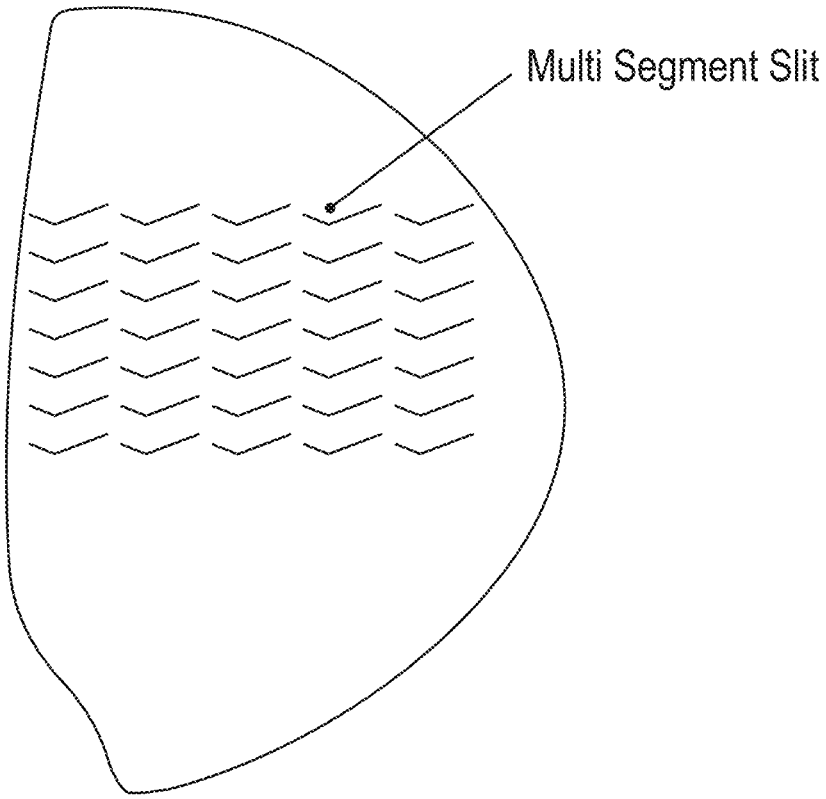
FIG. 50 is a top view of a ply with a non-uniform slit pattern, where the slits are multi-segment slits, for example, chevron-shaped.

With respect to FIG. 50, an exemplar of a non-uniform slit pattern, where the slits are multi-segment slits, is provided. As shown, the multi-segment slits may be chevron shaped. However, any multi-segment slit shape can be chosen, depending on the needs of the user to achieve more, or less, resin flow through the particular type of fabric ply chosen.

Figure 51:
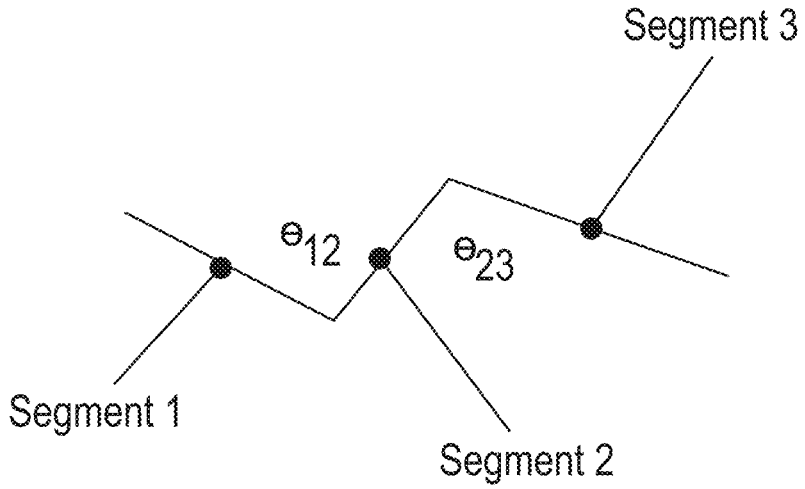
FIG. 51 is a schematic illustration of an example multi-segment slit, with defined angles between each segment of slit.
Figure 52:
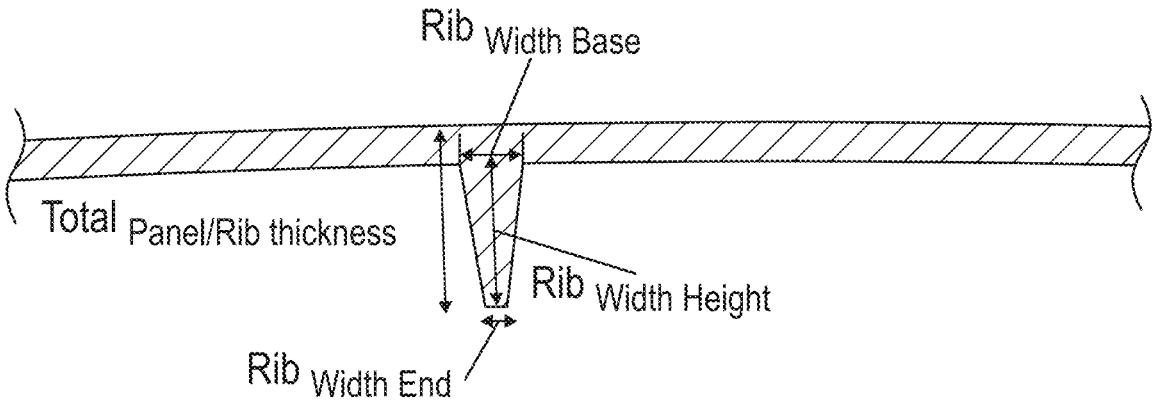
FIG. 52 is a schematic cross-sectional illustration of a composite layup with non-uniform, multi-segment slit patterns in the ply, in order to create "ribs" of cured resin material for reinforcement or strengthening of the composite layup component.

With respect to FIG. 51, an example of multi-segment slit, having three distinct line segments for each slit, is provided. As illustrated, a defined angle exists between each segment of slit. Again, in view of the foregoing disclosure, it will be understood that this type of slit may be chosen to control the flow of resin for the particular type of fabric ply chosen. As illustrated in FIG. 52, one purpose of such a multi-segment slit pattern is to create deep "ribs" of resin matrix in the cured composite part. Such ribs may be used to impart reinforcement or strength to particular regions of the composite part, while controlling and reducing the associated weight gain that would otherwise be associated with allowing full resin flow through in that region.

Figure 53A:
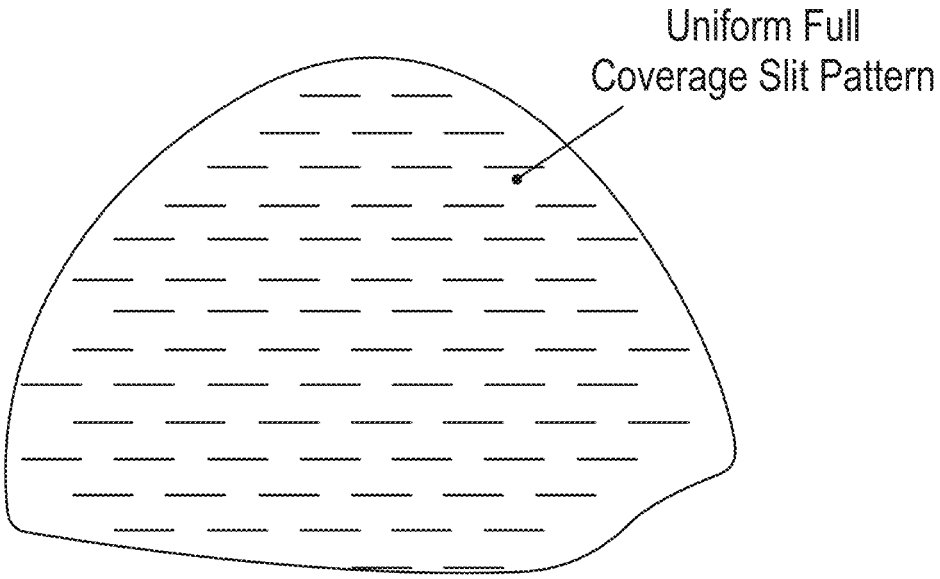
FIGS. 53*a-b* are examples of uniform full coverage slit patterns.
Figure 53B:
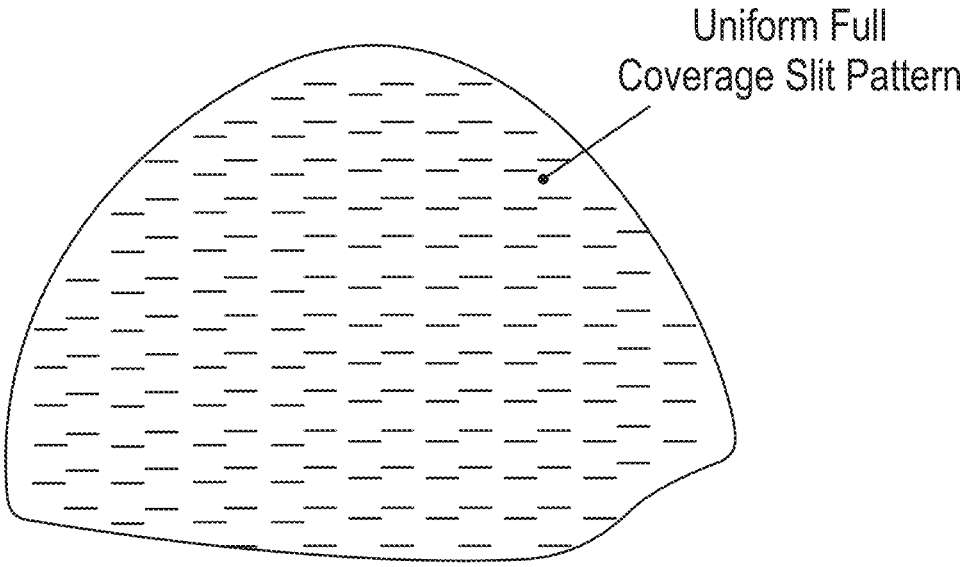
Figure 54A:
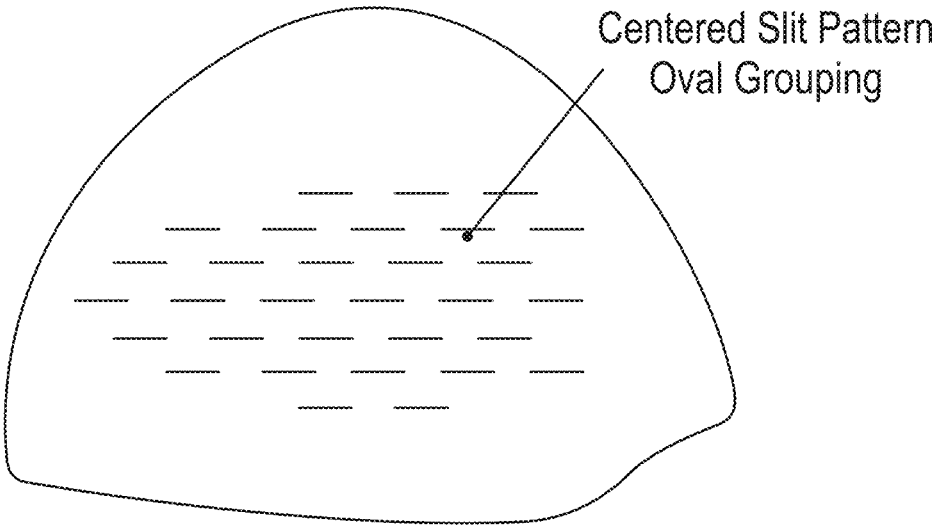
FIG. 54*a* is a top view of a ply with a non-uniform centered slit pattern in an oval grouping.
Figure 54B:
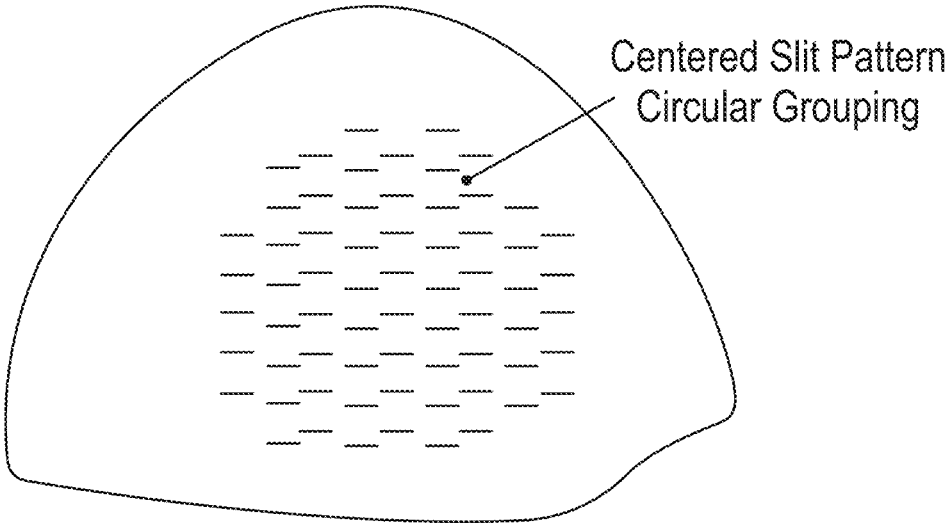
FIG. 54*b* is a top view of a ply with a non-uniform centered slit pattern in a circular grouping.
Figure 54C:
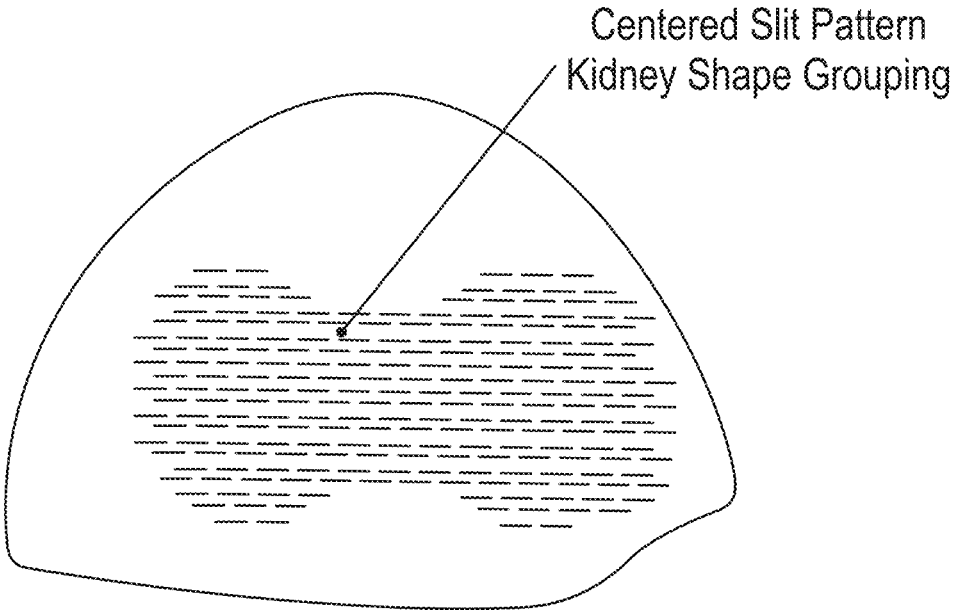
FIG. 54*c* is a top view of a ply with a non-uniform centered slit pattern in a kidney-shaped grouping.

With respect to FIGS. 53*a-b*, examples of uniform full coverage slit patterns are provided. In contrast, with respect to FIGS. 54*a-c* show examples of non-uniform slit patterns in a variety of shapes, for example in a centered oval grouping (FIG. 54*a*), a centered circular grouping (FIG. 54*b*), and a centered kidney-shaped grouping (FIG. 54*c*).

Figure 55:
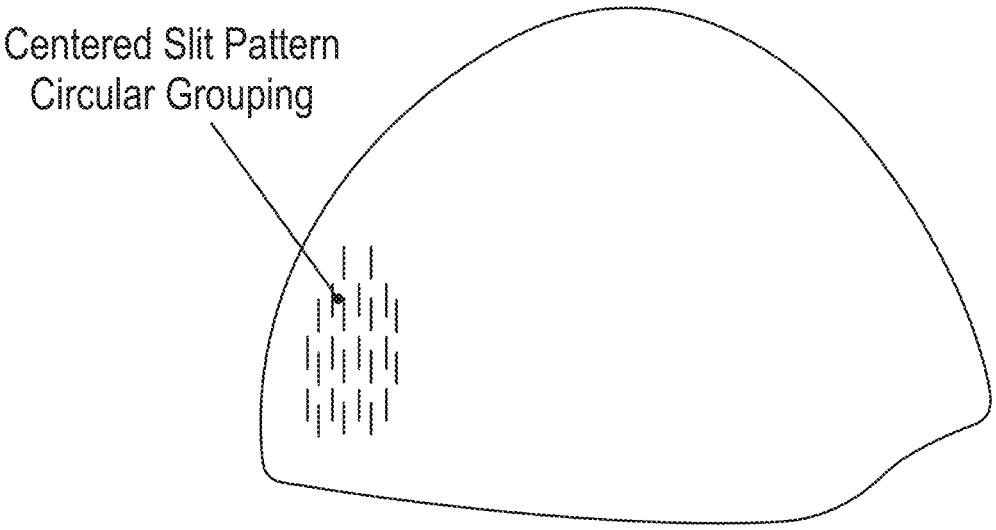
FIG. 55 is a top view of a ply with a non-uniform non-centered slit pattern in an oval/circular grouping, which is offset with respect to the center of the ply.

With respect to FIG. 55, it will be understood that the slit pattern may be offset from the center of the ply, as needed to accomplish the variable thickness needs of the designer.

Figure 56:
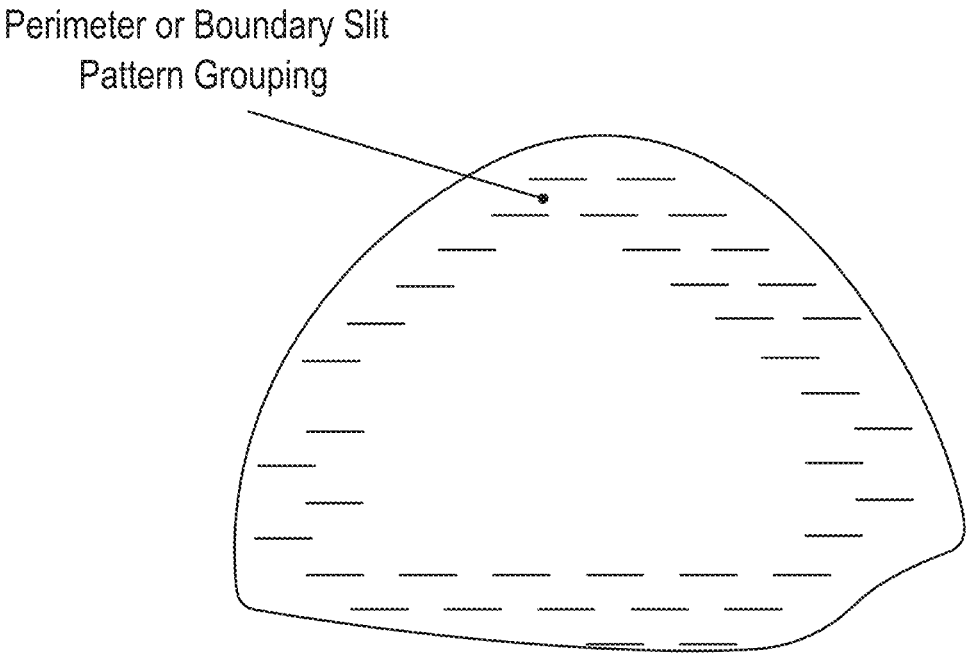
FIG. 56 is a top view of a ply with a non-uniform, non-centered slit pattern along the perimeter of the ply.

With respect to FIG. 56, it will be understood that the slit pattern may be a non-uniform, non-centered slit pattern along the perimeter of the ply.

Figure 57:
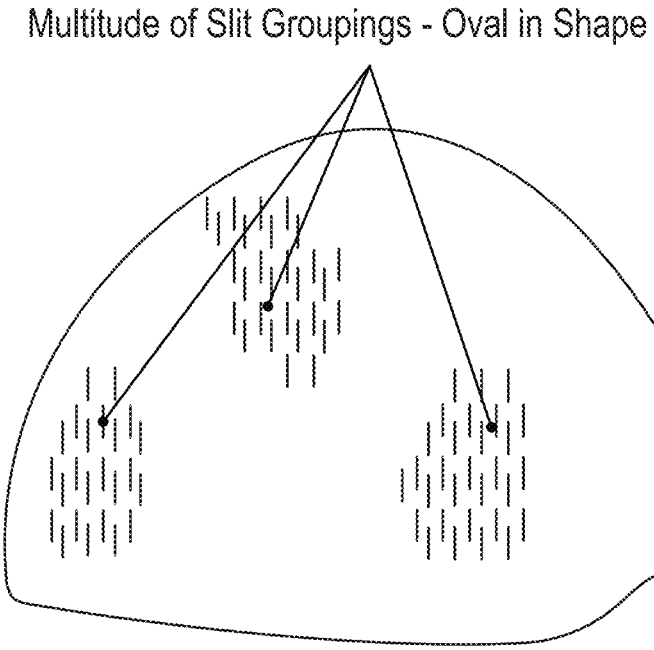
FIG. 57 is a top view of a ply with a non-uniform, non-centered, multitude of slit groupings, each of which is oval in shape.

With respect to FIG. 57, it will be understood that a designer may use a plurality of non-uniform slit groupings in a single ply.

Figure 58:
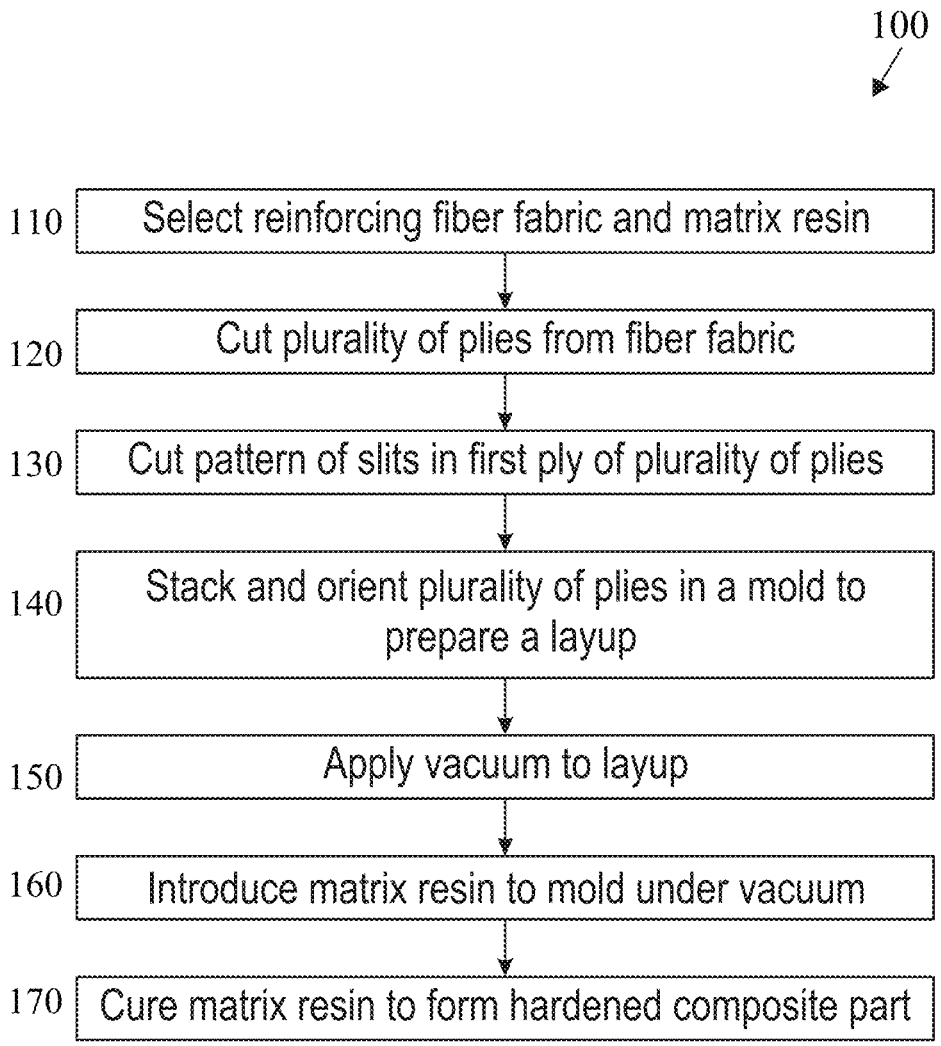
FIG. 58 is a process flow chart illustrating a method of the present invention.
Figure 59:
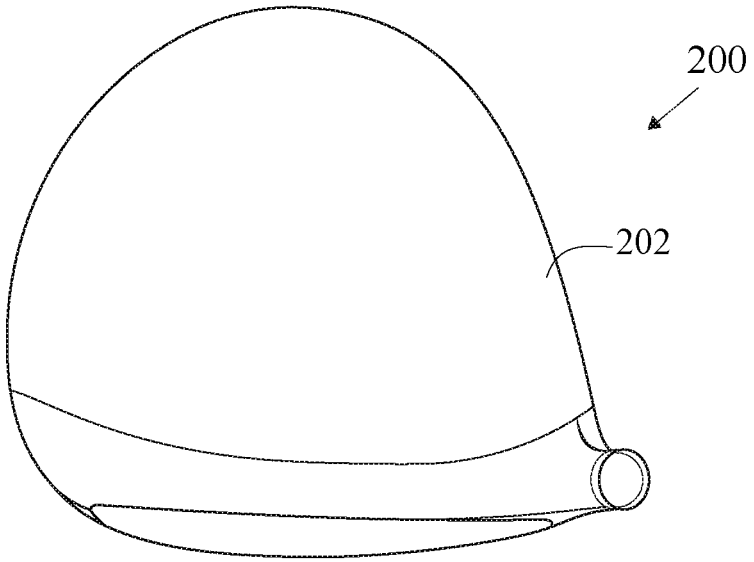
FIG. 59 is a top plan view of a golf club head.
Figure 60:
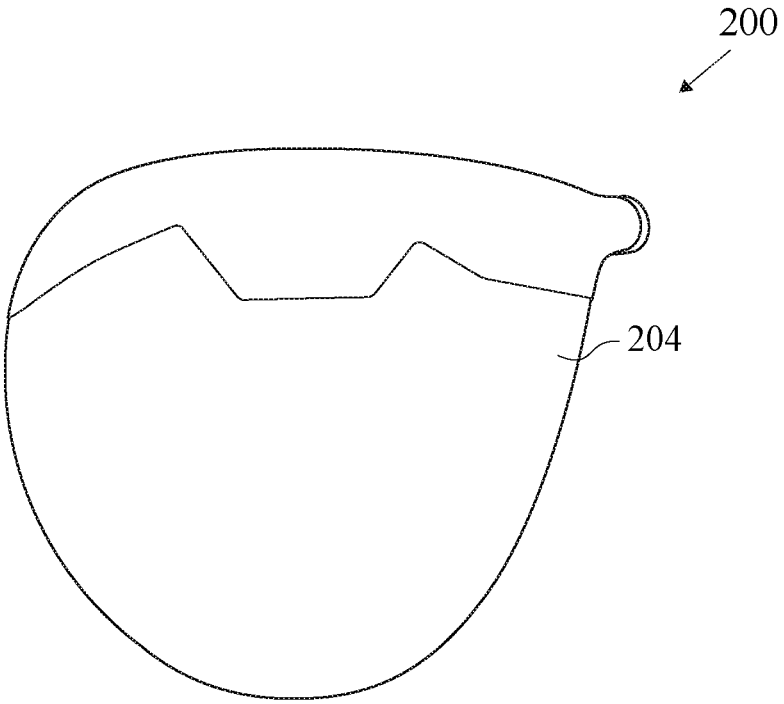
FIG. 60 is a sole elevational view of the golf club head shown in FIG. 59.
Figure 61:
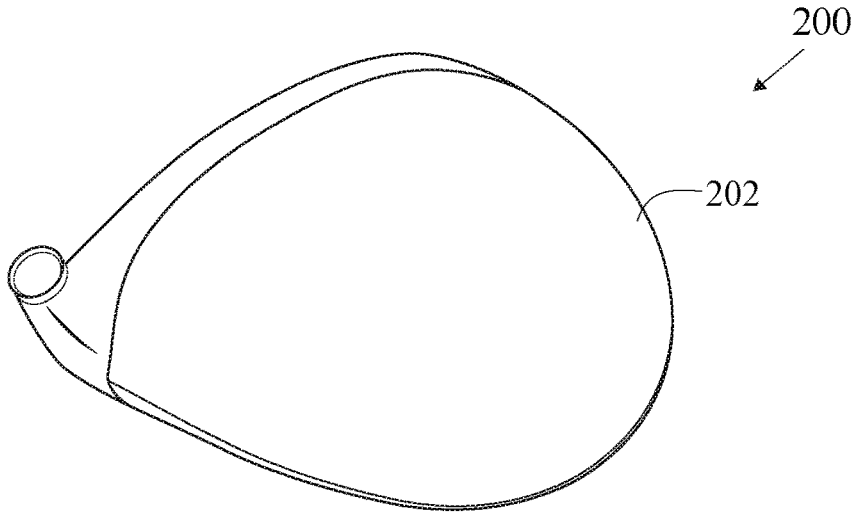
FIG. 61 is a top elevational view of the golf club head shown in FIG. 59.
Figure 62:
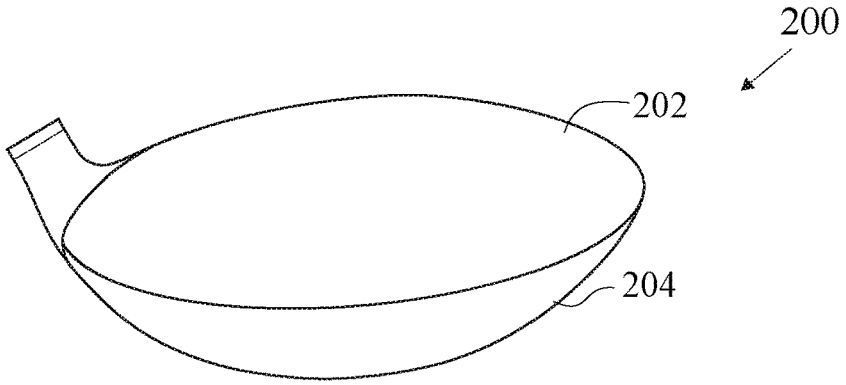
FIG. 62 is a back elevational view of the golf club head shown in FIG. 59.
Figure 63:
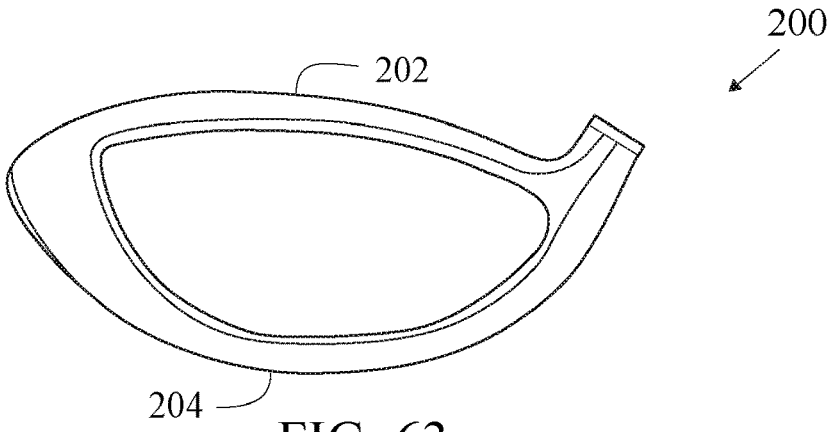
FIG. 63 is a face elevational view of the golf club head shown in FIG. 59.
Figure 64:
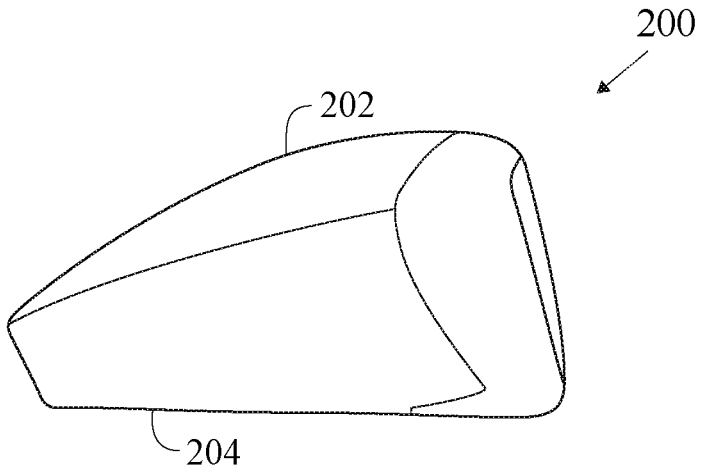
FIG. 64 is a heel elevational view of the golf club head shown in FIG. 59.
Figure 65:
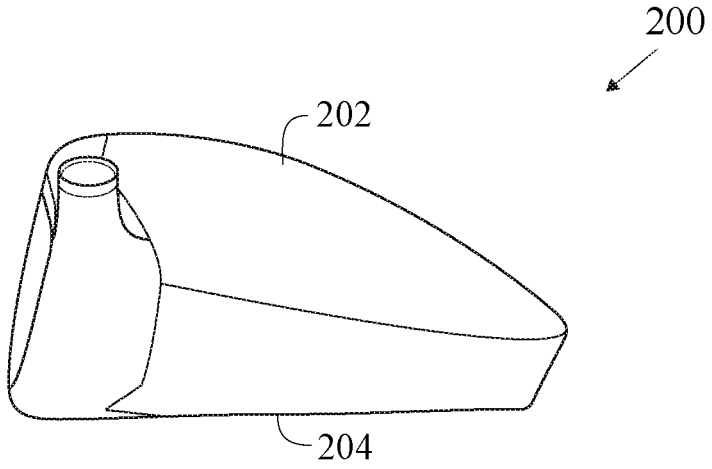
FIG. 65 is a toe elevational view of the golf club head shown in FIG. 59.

A method 100 of manufacturing the composite parts described above is illustrated in FIG. 58. This method includes the basic steps of selecting a reinforcing fiber fabric and a matrix resin 110, cutting a plurality of shaped plies from the reinforcing fiber fabric 120, cutting a pattern of slits in a first ply of the plurality of plies 130, where the first ply comprises a first plurality of tows, where the first ply has a first zone in which the first ply has been cut with a plurality of slits such that the first plurality of tows in the first zone are discontinuous, where the first ply has a second zone in which the first plurality of tows in the second zone are intact and continuous, preparing a layup by stacking and orienting the plurality of plies in a mold 140, applying vacuum to the layup 150, introducing the selected matrix resin to the layup under vacuum 160, where upon introduction of the selected matrix to the layup under vacuum, the first zone has a first cross-sectional thickness comprising the thickness of the first ply and the thickness of the cured matrix at the first zone, wherein the second zone has a second cross-sectional thickness comprising the thickness of the first ply and the thickness of the cured matrix at the second zone, where the first cross-sectional thickness is greater than the second cross-sectional thickness, and curing the matrix resin to form a hardened variable thickness composite part wherein the composite part has a composite part cross-sectional thickness that varies across the cross-section of the composite part 170.

The step of cutting the pattern of slits in the first ply can include the step of positioning a pattern cutting board in a mechanical press, where the pattern cutting board includes a backer board, a plurality of pattern blades affixed to the backer board in a desired pattern, where the mechanical press comprises a field for positioning, securing the first ply, and actuating the mechanical press, such that the backer board is brought into proximity of the field, and causes the plurality of pattern blades to cut slits into the first ply. Alternatively, the step of cutting the pattern of slits in the first ply can include programming an automated cutting table to cut the pattern of slits.

The step of preparing a layup by stacking and orienting the plurality of plies in a mold preferably includes identifying the directionality of the tow of each ply, and stacking the plurality of plies such that the first ply is oriented such that the directionality of the tows of the first ply is not parallel to the directionality of the tow of at least one other ply. Alternatively, the step of cutting a pattern of slits in a first ply of the plurality of plies includes identifying the directionality of each ply, stacking the plurality of plies in a desired orientation, to form a stack, such that each of the directionality of each ply is selected and maintained with respect to the directionality of each of the other plies in the stack of the plurality of plies, and applying a cutting device to the stack, thereby cutting the same slit pattern in every ply of the stack at the same time.

In another, the step of cutting a pattern of slits in a first ply of the plurality of plies includes identifying the directionality of each ply, stacking the plurality of plies such that the first ply is oriented such that its directionality is not parallel to the directionality of at least one other ply, selecting a pattern of slits comprising a cross-hatch pattern, whereby, when the cross-hatch pattern of slits is applied to the stack, slits will be cut into all plies of the plurality of plies, regardless of the directionality of each particular ply and regardless of the orientation of each particular ply.

FIGS. 59-65 illustrate an embodiment of a golf club head 200 of the present invention with a variable thickness composite crown 202 and a variable thickness composite sole 204.

Figure 66:
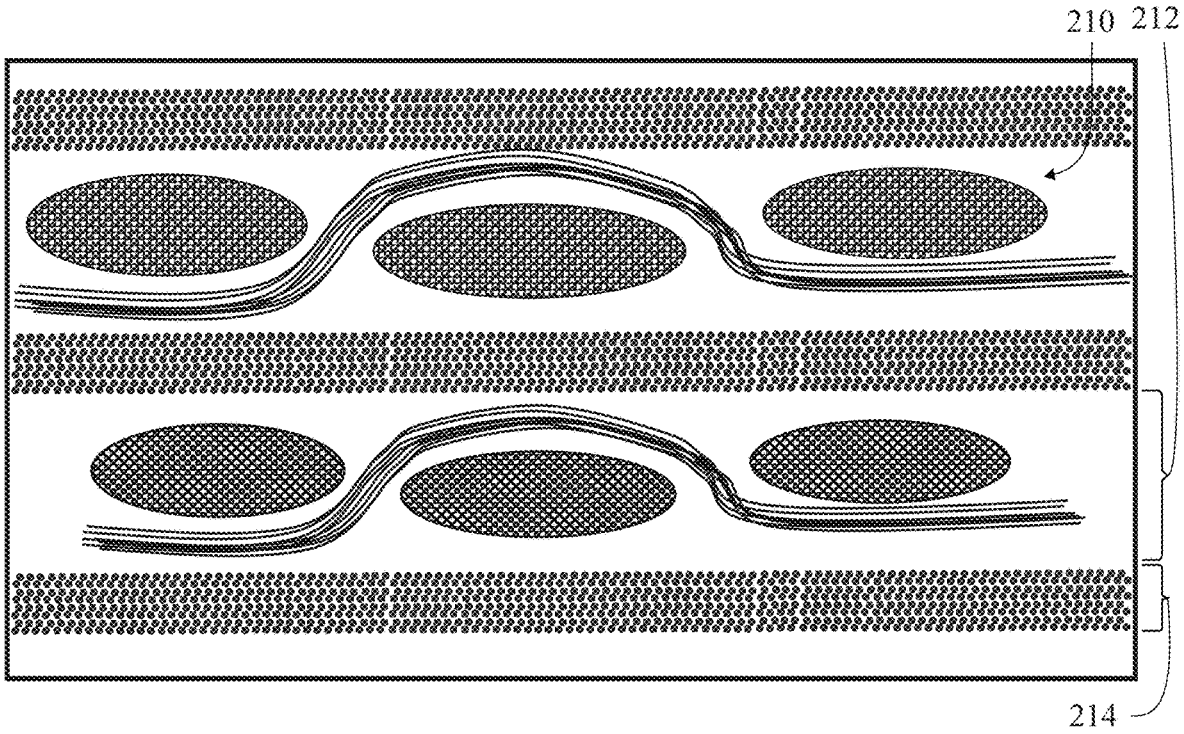
FIG. 66 is an illustration of a cross-section of a unidirectional and multi-axial composite layer laminate with a plurality of tows.

FIG. 66 illustrates a cross-section of a unidirectional and multi-axial composite laminate, showing multiple layers; a plurality of tows 210, multiaxial composite fabric plies 212, and unidirectional composite plies 214.

Figure 67:
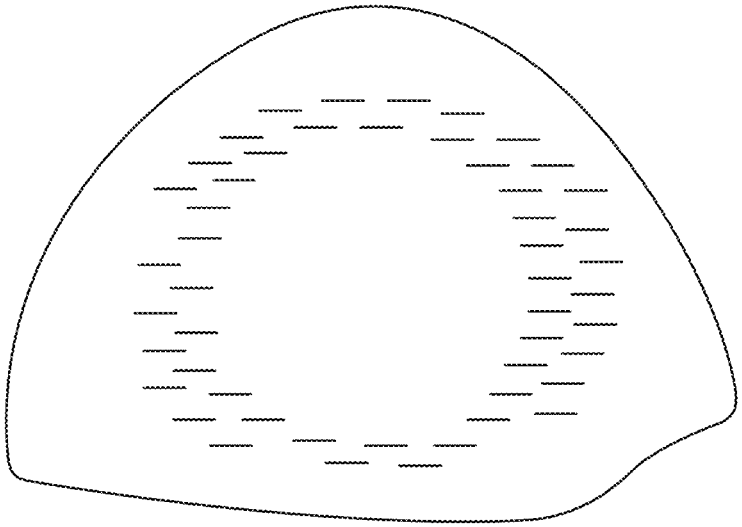
FIG. 67 is an illustration of another embodiment of a composite charge for a golf club head crown with a ring-shaped non-uniform slit pattern.
Figure 68:
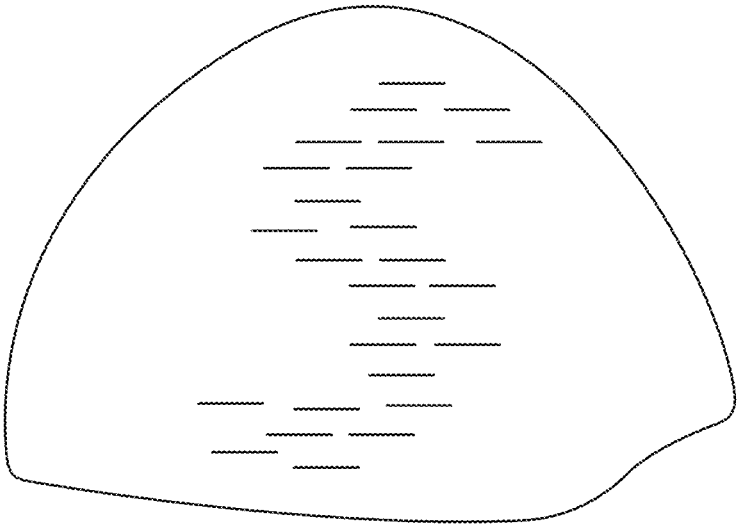
FIG. 68 is an illustration of another embodiment of a composite charge for a golf club head crown with an S-shaped non-uniform slit pattern.

FIGS. 67-68 illustrate different embodiments of a single ply charge 10 with a non-uniform pattern of slits, for example, ring-shaped and S-shaped, respectively.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications, combinations, and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising a component formed from composite materials, the component comprising:

a plurality of plies of reinforcement fabric; and a quantity of cured matrix, wherein the matrix is bonded to the plurality of plies of reinforcement fabric to form a unitary composite component, wherein at least a first ply of reinforcement fabric of the plurality of plies of reinforcement fabric comprises a first plurality of tows, wherein the first ply has a first zone in which the first ply has been cut with a plurality of slits such that the first plurality of tows in the first zone are discontinuous, wherein the first ply has a second zone in which the first plurality of tows in the second zone are intact and continuous, wherein the first zone has a first cross-sectional thickness comprising a thickness of the first ply and a thickness of the cured matrix at the first zone, wherein the second zone has a second cross-sectional thickness comprising a thickness of the first ply and a thickness of the cured matrix at the second zone, wherein the first cross-sectional thickness is greater than the second cross-sectional thickness, and whereby the component has a component cross-sectional thickness that varies across a cross-section of the component.

2. The golf club head of claim 1, wherein the component is selected from the group consisting of a golf club head crown and a golf club head sole.

3. The golf club head of claim 1, wherein the first ply has a third transitional zone positioned between the first zone and the second zone, wherein the third transitional zone has a third cross-sectional thickness comprising a thickness of the first ply and a thickness of the cured matrix at the third zone, and wherein the third-cross-sectional thickness is less than the first cross-sectional thickness but greater than the second cross-sectional thickness.

4. The golf club head of claim 3, further comprising:

a first thickness defined at a first point of the component in the second zone; and a second thickness defined at a second point of the component in the first zone, wherein a component thickness variation is defined as a difference between the second thickness and the first thickness, and wherein the component thickness variation ranges between 0.010 inch and 0.50 inch.

5. The golf club head of claim 4, further comprising:

a dimension L defined as a length between the first point and the second point;

a thickness rate of change defined as a rate of change along the cross-section of the component, and which is defined by a formula as follows:

$$\text{Thickness rate of change} = \frac{\text{Second Thickness} - \text{First Thickness}}{L}$$

wherein the thickness rate of change is in a range between 0 in/in and 5 in/in.

6. The golf club head of claim 5, wherein dimension L is between 0.010 inch and 0.50 inch.

7. The golf club head of claim 3, further comprising:

a first thickness defined at a first point of the component in the second zone; and a second thickness defined at a second point of the component in the first zone, wherein a component thickness variation is defined as a difference between the second thickness and the first thickness, wherein the component thickness variation ranges between 0.010 inch and 0.50 inch, a dimension L defined as a length between the first point and the second point, wherein dimension L ranges between 0.010 inch and 0.50 inch, a component thickness rate of change defined as a rate of change along the cross-section of the component and which is defined by a formula as follows:

$$\text{Thickness}_{Change} = \lim_{h \to 0} \frac{\text{Thickness}(x+h) - \text{Thickness}(x)}{h}$$

wherein the component thickness rate of change is in a range between 0 in/in and 5 in/in.

8. The golf club head of claim 3, wherein the first ply further comprises:

an area charge defined as a surface area of the first ply; and a cut length defined as a length of each of the plurality of slits, wherein n is defined as an exact number of slits of the plurality of slits in the first ply, a cut ply ratio defined by a formula as follows:

$$\text{Cut_Ply_Ratio} = \frac{\left(\sum_{k=1}^{n} \text{Cut_Length}_k\right)}{\text{Area}_{Charge}}$$

and;

wherein the cut ply ratio is between 0.1 in/in$^2$ and 100 in/in$^2$.

9. The golf club head of claim 8, wherein the cut length varies between 0.020 inch and 2.00 inches.

10. The golf club head of claim 8 further comprising:

a number m defined as a total number of plies in the plurality of plies; and a number n defined as a total number of slits per ply m, wherein a cut layup ratio is defined by a formula as follows:

$$\text{Cut_Ply_Ratio} = \frac{\left(\sum_{k=1}^{n} \text{Cut_Length}_k\right)}{\text{Area}_{Charge}}$$

and;

wherein the cut layup ratio varies in a range between 0.05 in/in$^2$ and 200 in/in$^2$.

11. The golf club head of claim 1, wherein the plurality of slits is configured in a pattern.

12. The golf club head of claim 1, wherein at least some of the plurality of slits are straight line segments.

13. The golf club head of claim 1, wherein at least some of the plurality of slits are curves.

14. The golf club head of claim 13, wherein the curves have a minimum radius of curvature of 0.10 inch.

15. The golf club head of claim 1, wherein at least some of the plurality of slits are multi-segment slits.

16. The golf club head of claim 1, wherein a second ply of reinforcement fabric of the plurality of plies of reinforcement fabric comprises a second plurality of tows, and wherein the second ply is oriented with respect to the first ply such that the second plurality of tows is not parallel to the first plurality of tows.

17. The golf club head of claim 16, wherein the second ply has a fourth zone in which the second ply has been cut with a plurality of slits such that the second plurality of tows in the fourth zone are discontinuous, wherein the second ply has a fifth zone in which the second plurality of tows in the fifth zone are intact and continuous, and wherein the positioning of the plurality of slits in the fourth zone is different from the positioning of the plurality of slits in the first zone.

18. The golf club head of claim 1, wherein a number of plies of the plurality of plies varies between 2 and 50.

19. The golf club head of claim 1, wherein the plurality of slits are grouped into a shape and wherein the shape is selected from the group consisting of a circle, an oval, a kidney, a ring, and an "S".

20. The golf club head of claim 1, wherein the plurality of slits are concentrated around a perimeter of the first ply.

* * * * *